US010076461B2

(12) United States Patent
Matjacic et al.

(10) Patent No.: US 10,076,461 B2
(45) Date of Patent: Sep. 18, 2018

(54) APPARATUS FOR TRAINING DYNAMIC BALANCE AND TURNING MANOEUVRES DURING WALKING

(71) Applicant: Univerzitetni rehabilitacijski institut Republike Slovenije-Soca, Ljubljana (SI)

(72) Inventors: Zlatko Matjacic, Ljubljana (SI); Andrej Olensek, Dobrna (SI)

(73) Assignee: Univerzitetni rehabilitacijski institut Republike Slovenije-Soca (SI)

( * ) Notice: Subject to any disclaimer, the term of this patent is extended or adjusted under 35 U.S.C. 154(b) by 0 days.

(21) Appl. No.: 14/718,341

(22) Filed: May 21, 2015

(65) Prior Publication Data

US 2017/0216126 A1 Aug. 3, 2017

Related U.S. Application Data

(63) Continuation of application No. PCT/SI2013/000073, filed on Nov. 21, 2013.

(30) Foreign Application Priority Data

Nov. 21, 2012 (SI) ..... 201200354
May 30, 2013 (SI) ..... 201300140

(51) Int. Cl.
*A61H 3/00* (2006.01)
*A61H 3/04* (2006.01)
(Continued)

(52) U.S. Cl.
CPC ..... *A61H 3/008* (2013.01); *A61H 3/04* (2013.01); *A63B 21/4009* (2015.10);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 1,561,960 A * 11/1925 Ungar ..... A63B 69/3667 473/216
3,463,146 A * 8/1969 Day ..... A61H 3/04 180/119

(Continued)

*Primary Examiner* — Loan H Thanh
*Assistant Examiner* — Gary D Urbiel Goldner
(74) *Attorney, Agent, or Firm* — Jovan N. Jovanovic; Vladan Vasiljevic; The Watson I.P. Group, PLC

(57) ABSTRACT

The object of the invention is an apparatus suited for individuals in training dynamic balance and turning maneuvers while walking, said apparatus allowing said maneuvers while an individual is standing, walking on a flat surface or walking on a treadmill that can rotate around a vertical axis of the treadmill. To serve this purpose, the apparatus of the invention is provided with a base platform (1), in which two universal joints (2,2') are arranged that are connected with a pelvis element (5) with two vertical rods (3,3') or vertically adjustable rods (30,30') via conventional spherical joints (4,4'), and the universal joints (2,2') have two degrees of freedom that can further be provided by drives (6,7,8).

5 Claims, 41 Drawing Sheets

Figure 1A:
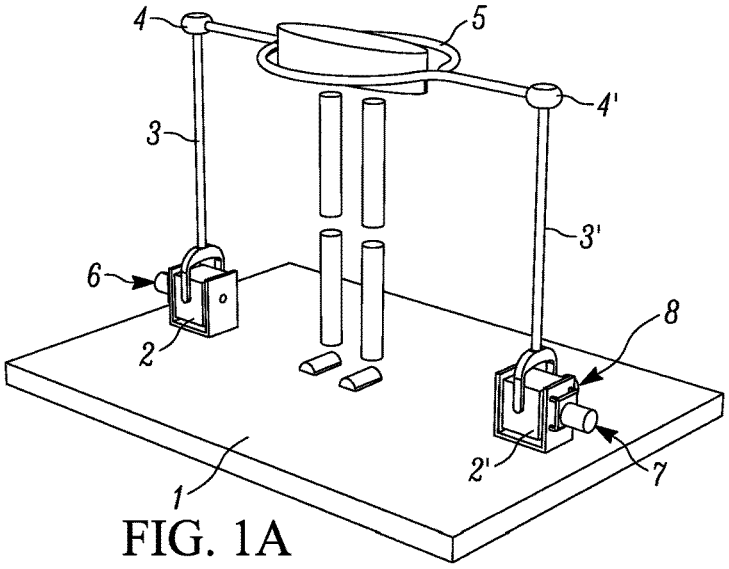
Figure 1B:
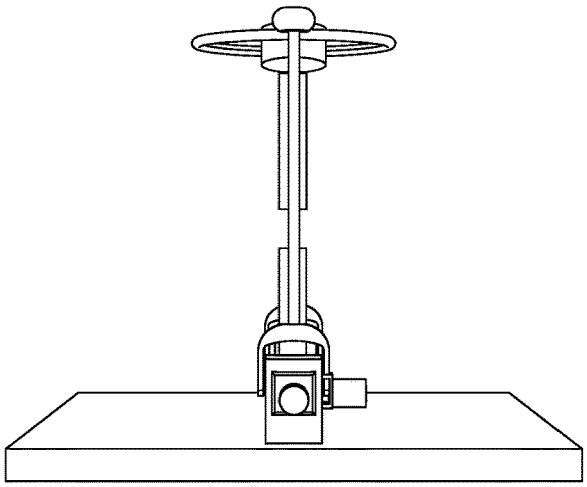
Figure 1C:
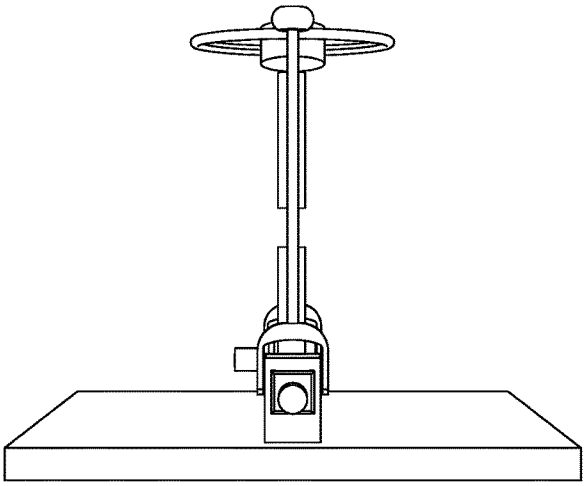
Figure 1D:
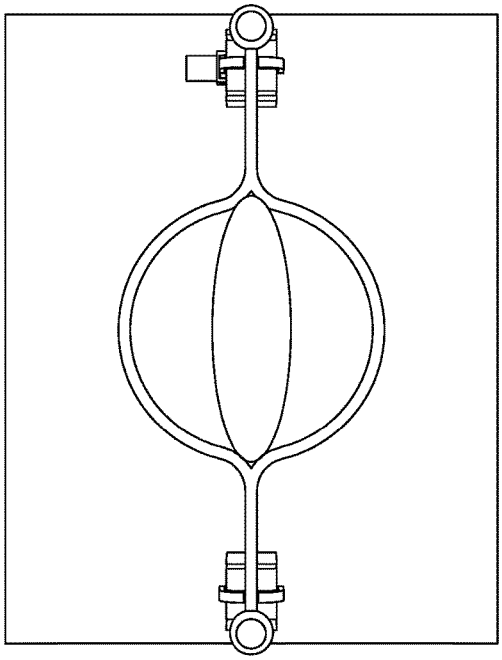
Figure 1E:
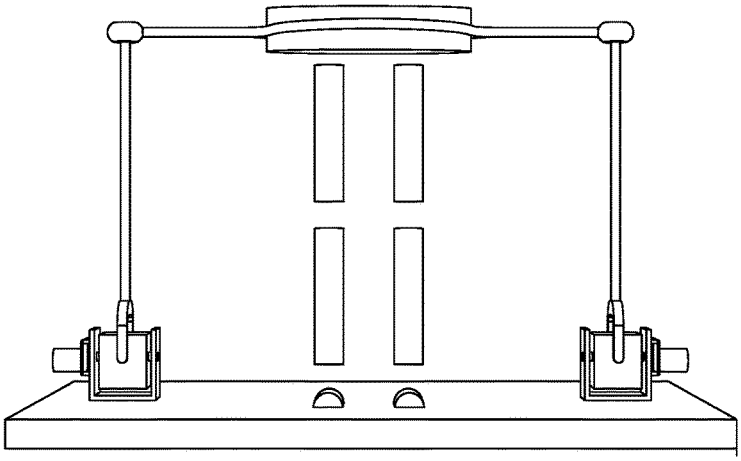
Figure 1F:
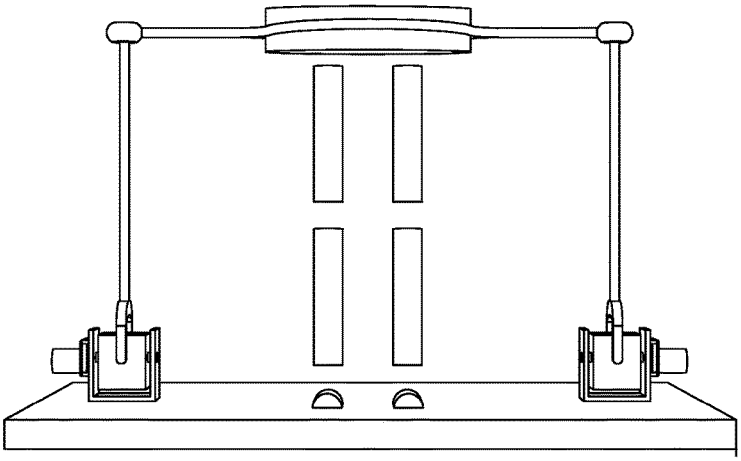
Figure 2A:
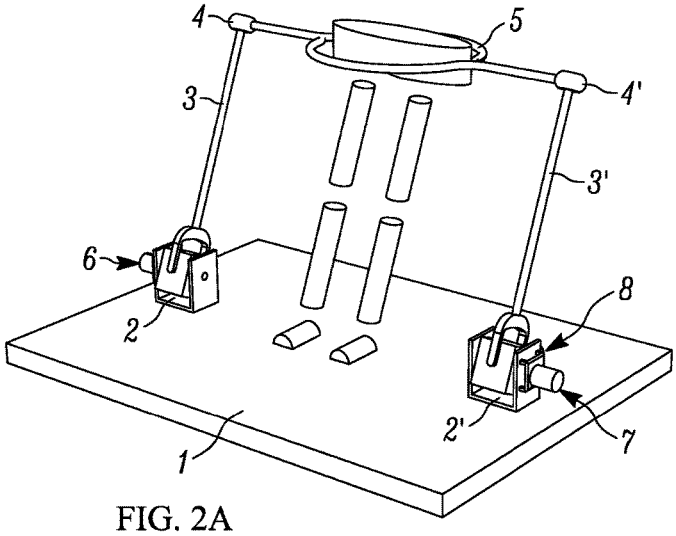
Figure 2B:
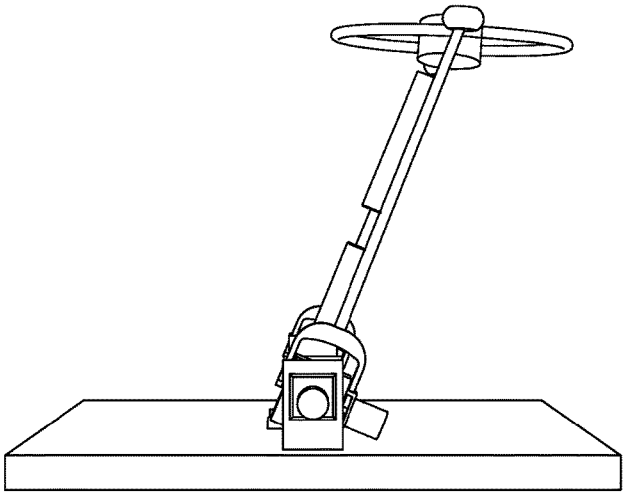
Figure 2C:
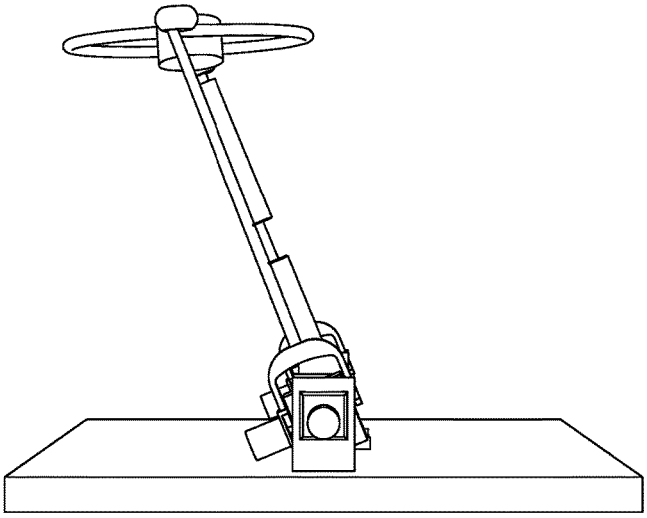
Figure 2D:
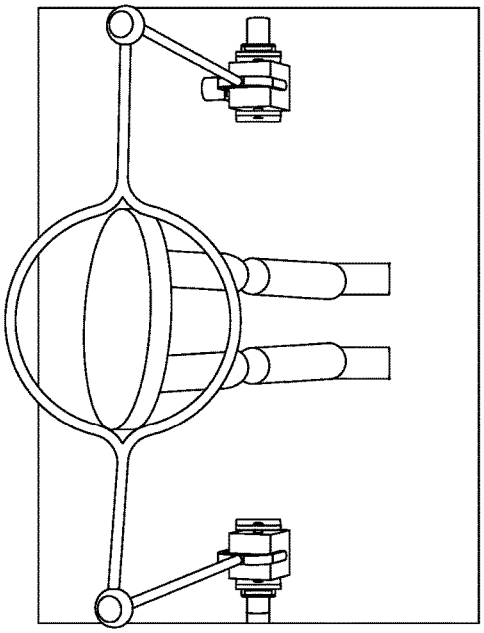
Figure 2E:
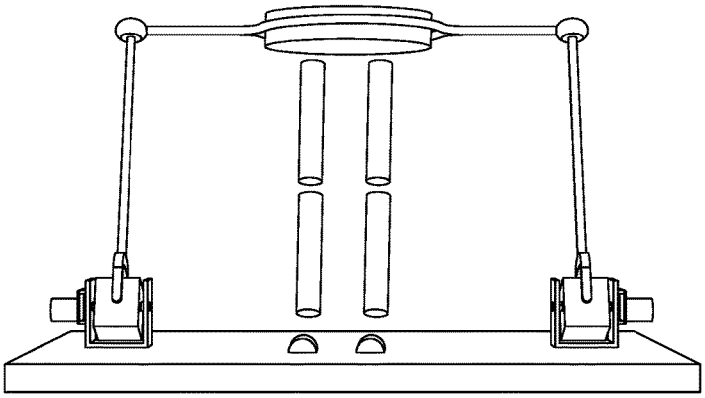
Figure 2F:
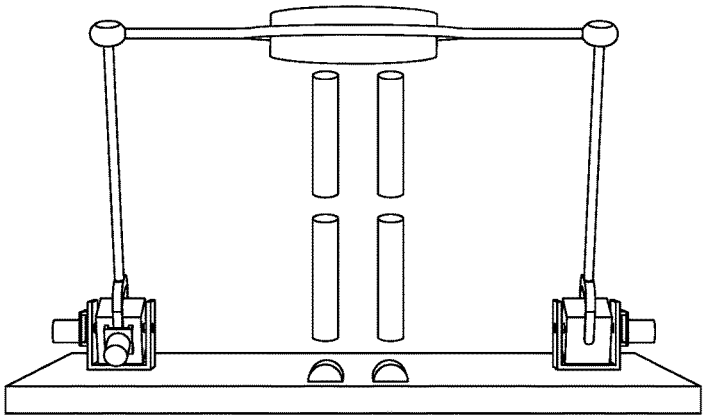
Figure 3A:
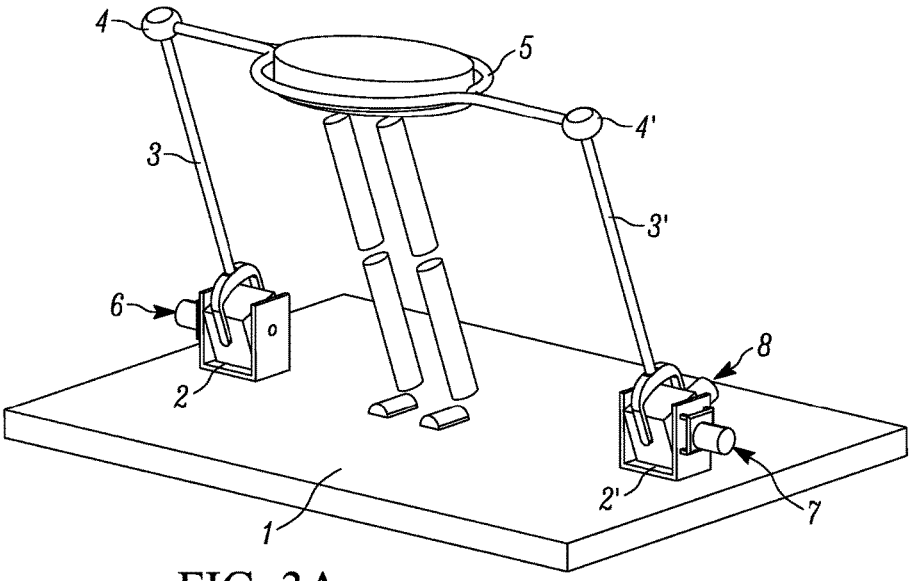
Figure 3B:
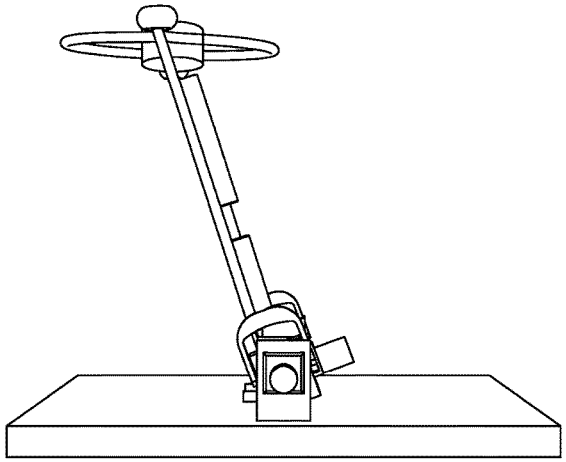
Figure 3C:
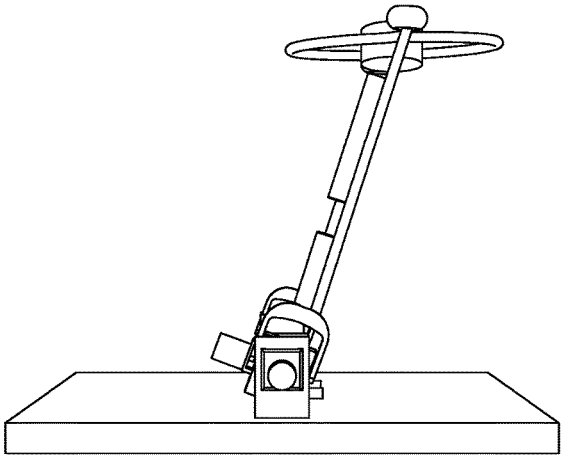
Figure 3D:
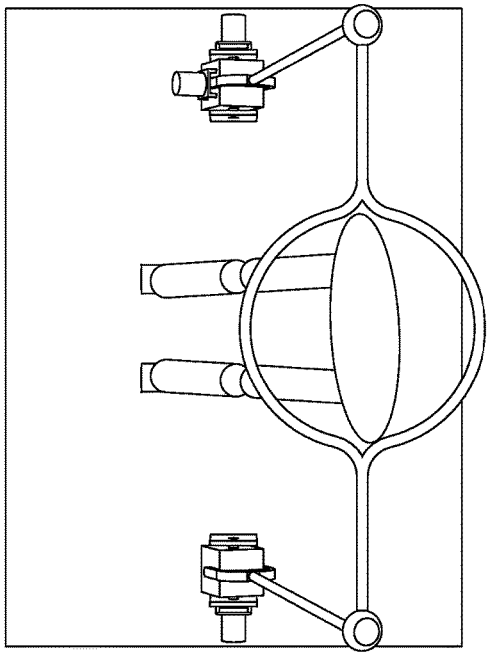
Figure 3E:
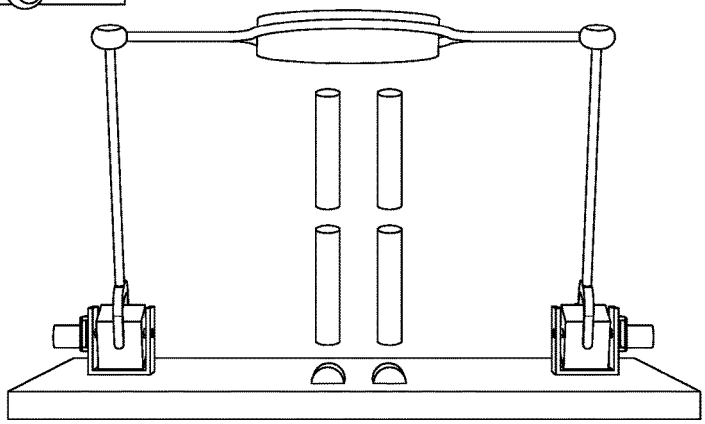
Figure 3F:
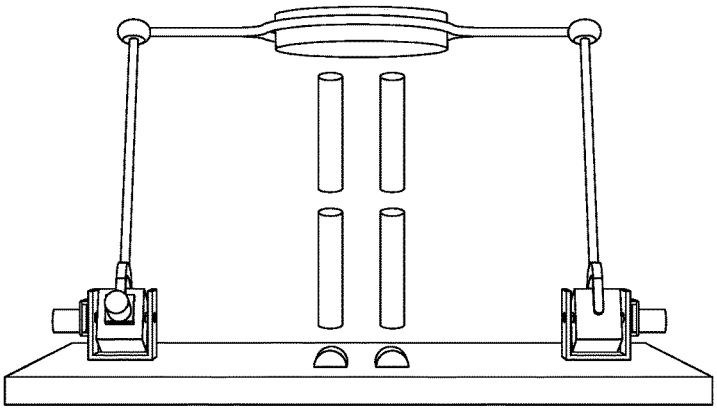
Figure 4A:
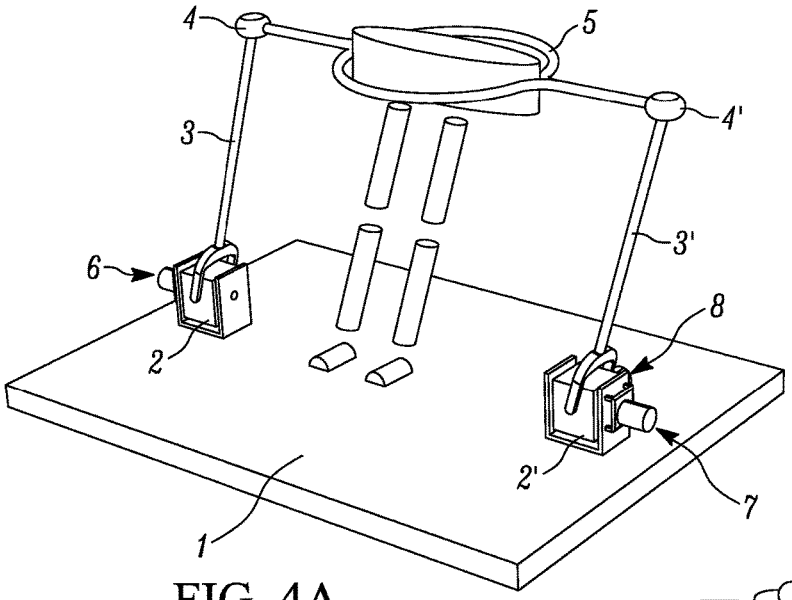
Figure 4B:
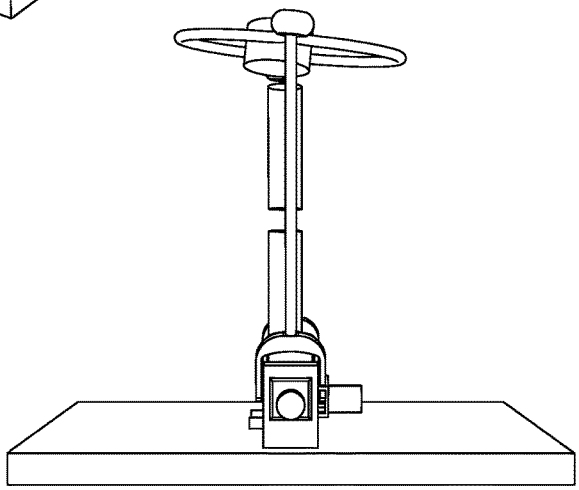
Figure 4C:
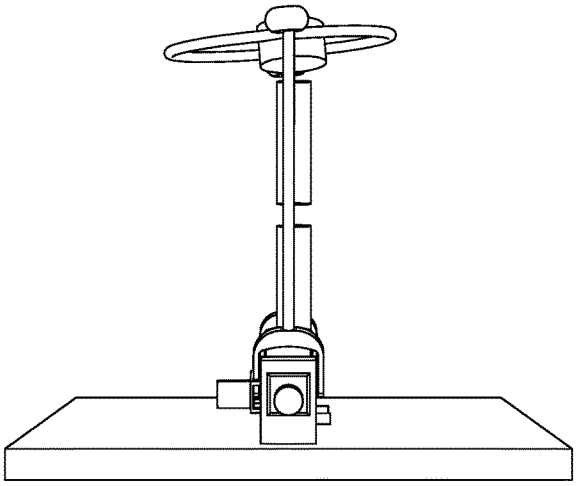
Figure 4D:
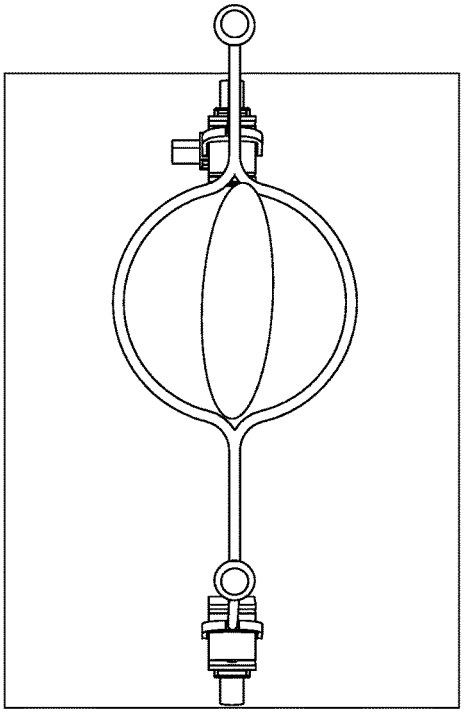
Figure 4E:
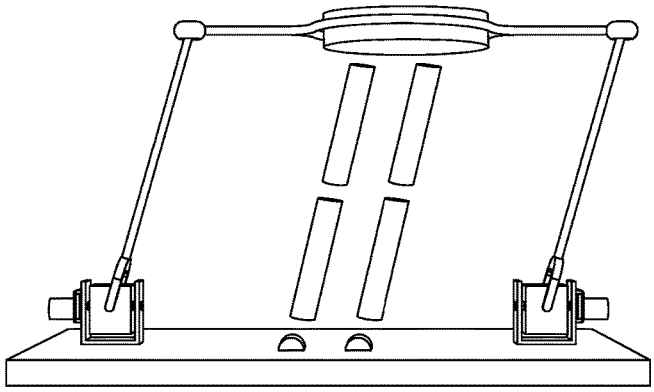
Figure 4F:
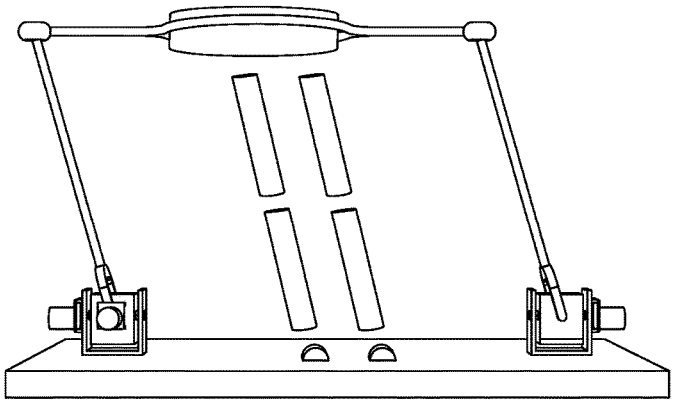

(51) Int. Cl.

| | |
|---|---|
| ***A63B 21/00*** | (2006.01) |
| ***A63B 22/00*** | (2006.01) |
| ***A63B 22/02*** | (2006.01) |
| ***A63B 22/14*** | (2006.01) |
| ***A63B 26/00*** | (2006.01) |

(52) U.S. Cl.
CPC ..... *A63B 22/02* (2013.01); *A63B 22/14* (2013.01); *A63B 26/003* (2013.01); *A61H 2201/1207* (2013.01); *A61H 2201/163* (2013.01); *A63B 2022/0092* (2013.01)

(58) Field of Classification Search
CPC ..... A63B 21/00178; A63B 21/00181; A63B 21/00185; A63B 21/002; A63B 21/0023; A63B 21/005; A63B 21/0058; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/0615; A63B 21/0616; A63B 21/0617; A63B 21/0618; A63B 21/065; A63B 21/068; A63B 21/08; A63B 21/15; A63B 21/159; A63B 21/22; A63B 21/222; A63B 21/225; A63B 21/227; A63B 21/4009; A63B 21/4027; A63B 21/4033; A63B 21/4034; A63B 21/4039; A63B 21/4045; A63B 21/4047; A63B 21/4049; A63B 22/0015; A63B 22/0017; A63B 22/0023; A63B 22/0046; A63B 22/0048; A63B 22/02; A63B 22/14; A63B 22/18; A63B 22/20; A63B 22/201; A63B 22/203; A63B 22/208; A63B 2022/002; A63B 2022/0051; A63B 2022/0092; A63B 2022/094; A63B 2022/0097; A63B 2022/206; A63B 23/02; A63B 23/0205; A63B 23/0211; A63B 23/0216; A63B 23/0222; A63B 23/0233; A63B 23/035; A63B 23/03516; A63B 23/04; A63B 23/0405; A63B 23/047; A63B 23/0482; A63B 23/0494; A63B 2023/003; A63B 2023/006; A63B 24/0087; A63B 2024/0093; A63B 26/00; A63B 26/003; A63B 69/0028; A63B 69/0035; A63B 69/0057; A63B 69/0059; A63B 69/0064; A63B 71/0054; A63B 2071/0063; A63B 2071/0072; A63B 2071/0081; A63B 2208/02; A63B 2208/0204; A63B 2225/09; A63B 2225/093
See application file for complete search history.

(56) References Cited

U.S. PATENT DOCUMENTS

| | | | | | |
|---|---|---|---|---|---|
| 3,587,319 | A * | 6/1971 | Andrews | A63B 21/0083 | 482/112 |
| RE28,103 | E * | 8/1974 | Schwartz | A61H 3/04 | 180/119 |
| 5,372,564 | A * | 12/1994 | Spirito | A63B 23/03533 | 482/111 |
| 7,086,996 | B2 * | 8/2006 | Matjacic | A61B 5/1036 | 482/121 |
| 7,094,187 | B1 * | 8/2006 | Rizzo | A63B 9/00 | 482/135 |
| 7,125,388 | B1 * | 10/2006 | Reinkensmeyer | A63B 69/0064 | 601/23 |
| 8,083,655 | B2 * | 12/2011 | Hoebel | A61H 3/008 | 482/121 |
| 9,427,374 | B2 * | 8/2016 | Hoebel | A61H 3/008 | |
| 2003/0181299 | A1 * | 9/2003 | Matjacic | A61B 5/1036 | 482/146 |
| 2007/0056592 | A1 * | 3/2007 | Angold | A61H 3/00 | 128/845 |
| 2007/0087922 | A1 * | 4/2007 | Rizzo | A63B 21/00185 | 482/135 |
| 2009/0292369 | A1 * | 11/2009 | Kazerooni | A61H 3/00 | 623/27 |
| 2009/0318271 | A1 * | 12/2009 | Hobel | A61H 3/008 | 482/66 |
| 2010/0170546 | A1 * | 7/2010 | Popovic | A61H 3/008 | 135/67 |
| 2010/0248918 | A1 * | 9/2010 | Nakamura | A63B 21/04 | 482/139 |
| 2011/0105966 | A1 * | 5/2011 | Kazerooni | A61H 3/008 | 601/35 |
| 2012/0068422 | A1 * | 3/2012 | Kanaoka | B62D 57/032 | 280/1.181 |
| 2012/0309598 | A1 * | 12/2012 | Brentham | A63B 21/0083 | 482/112 |
| 2015/0080187 | A1 * | 3/2015 | Beane | A63B 69/0064 | 482/51 |
| 2015/0265872 | A1 * | 9/2015 | Sela | A63B 21/15 | 482/133 |

* cited by examiner

APPARATUS FOR TRAINING DYNAMIC BALANCE AND TURNING MANOEUVRES DURING WALKING

CROSS-REFERENCE TO RELATED APPLICATION

This application is a continuation of International Application No. PCT/SI2013/000073 filed Nov. 21, 2013, entitled "Apparatus For Training Dynamic Balance And Turning Manoeuvres During Walking" the specification of which is incorporated by reference herein.

The object of the invention is an apparatus for training dynamic balance and turning manoeuvres during walking. The apparatus of the invention is suited for individuals in training dynamic balance and various turning manoeuvres while standing, while walking on a flat surface or while walking on a treadmill that can rotate around its vertical axis. The invention belongs to class A 63B 26/00 of the European Patent Classification.

The technical problem successfully solved by the apparatus of the present invention is to provide such an aid that would allow suitable and especially safe dynamic balance training and consequently coordinated motion of the entire body especially of elderly and disabled individuals.

A variety of neurological disorders, as well as aging, result in a reduced ability to walk, which increases the odds of the disabled and also elderly population to fall. Apart from reduced muscular strength, inadequate sensory-motor coordination of motion and reduced abilities to turn or manoeuvre pose the main obstacle to functional walking. The mentioned abilities need to be maintained or re-trained, wherein it is important that training is done in a safe way and should include dynamic balance training. An important part of functional abilities to walk comprises manoeuvres such as initiation and acceleration, stopping and deceleration, changing direction while walking and turning, turning on the spot and backward walking. Currently, there are numerous electromechanical devices (e. g. LOKOMAT, GAIT TRAINER) that support walking either on a treadmill or on the floor and simultaneously offer a partial weight relief; however, said devices only provide for walking in one direction and what's more important the mobility of the pelvis and the body is considerably limited.

An apparatus, in which the movement of the pelvis is provided for in directions left/right and forward/backwards while an individual is standing is disclosed in U.S. Pat. No. 7,086,996. The main constructional feature of said apparatus resides in two mechanical assemblies comprising a vertical spring, the effective length of which can be changed in a simple way thus setting the extent of a mechanical bracing of the pelvis belt. The apparatus has two degrees of freedom: it provides for a body inclination while standing on the spot forward and backwards and left and right. It does not provide for rotation of the body around a vertical axis, which is of key importance when changing a walking direction.

The described prior art does not disclose an apparatus that would allow dynamic balance training in conditions, in which the pelvis and the body are adequately supported and yet coordinated motion of the entire body could be trained, which is needed in performing the above-mentioned manoeuvres. The described training is currently only possible by assistance of at least two physiotherapists.

The apparatus of the invention consists of a parallel mechanism, where universal joints are arranged in a base platform, said joints being connected via conventional spherical joints with a pelvis element in the first embodiment with two vertical rods and in the second embodiment with two vertical telescopic rods, said universal joints having two degrees of freedom that may be provided with a drive.

Figure 5A:
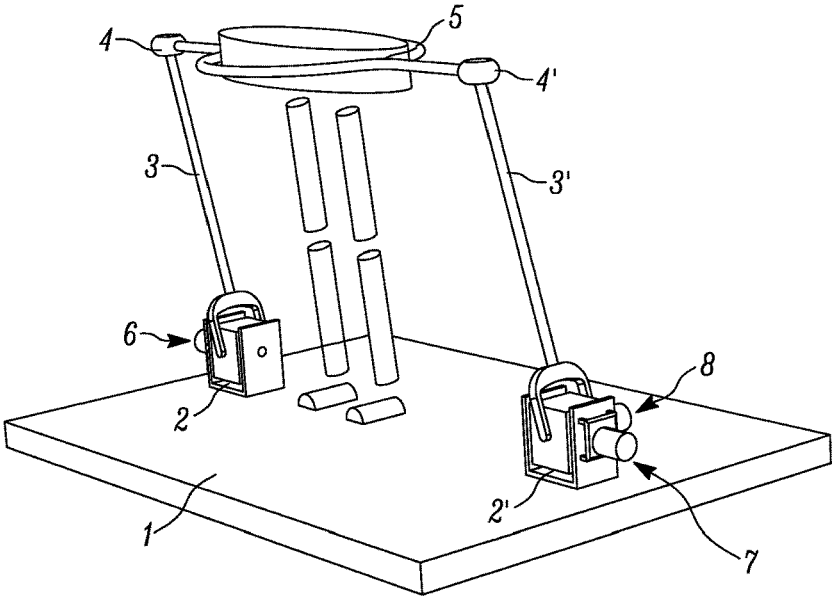
Figure 5B:
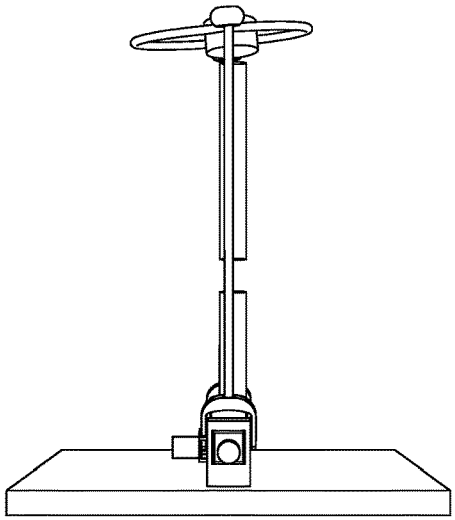
Figure 5C:
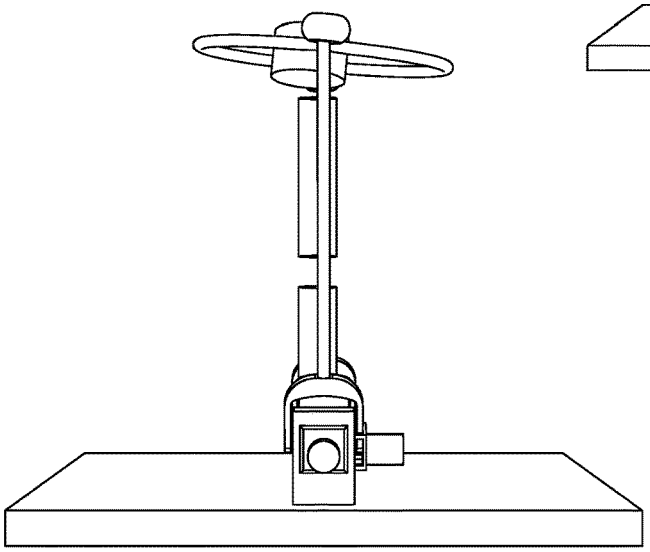
Figure 5D:
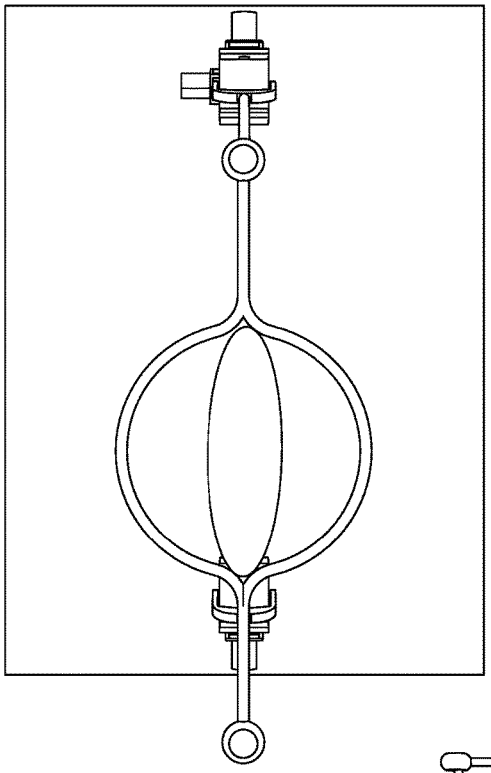
Figure 5E:
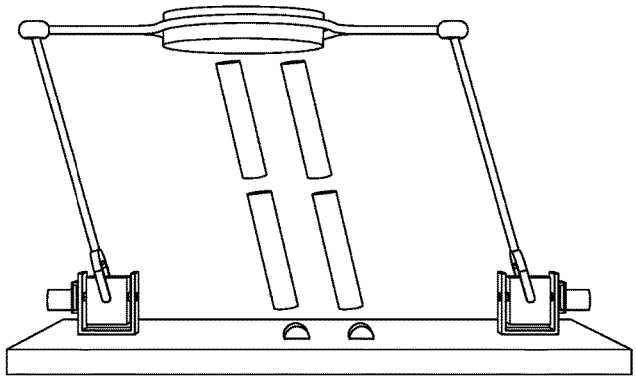
Figure 5F:
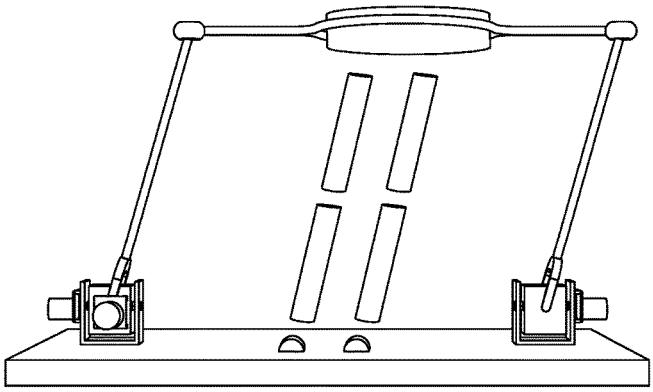
Figure 6A:
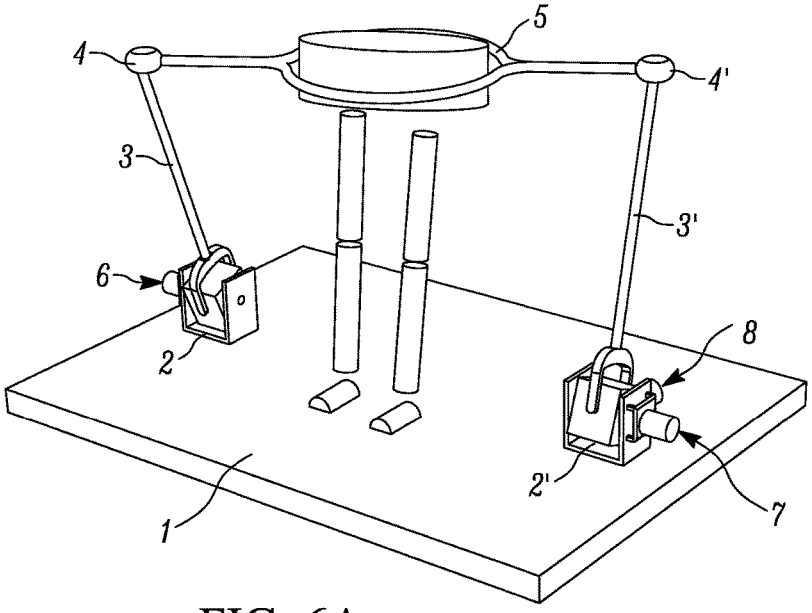
Figure 6B:
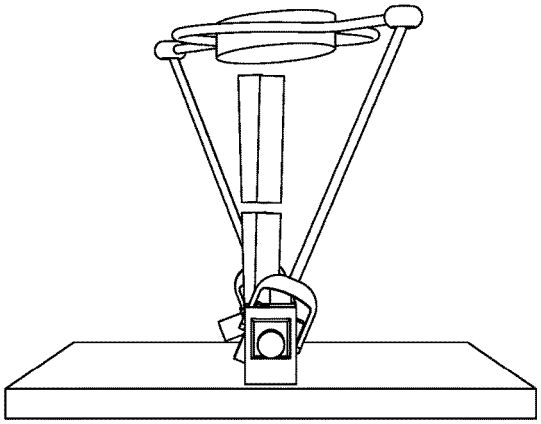
Figure 6C:
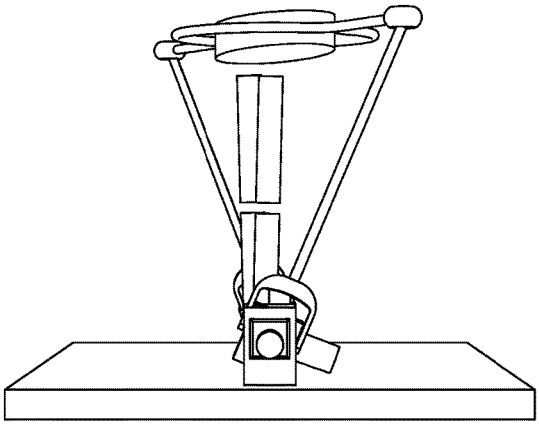
Figure 6D:
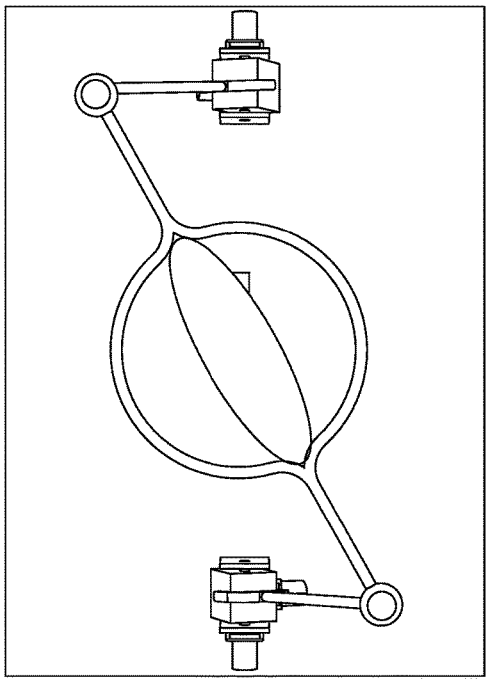
Figure 6E:
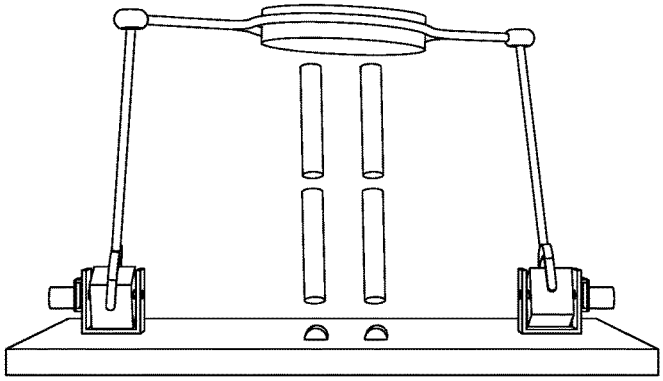
Figure 6F:
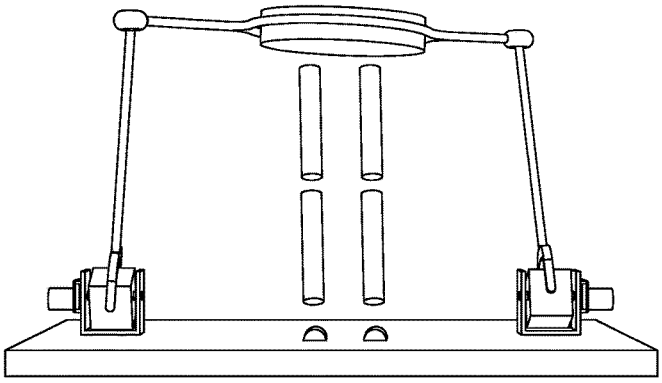
Figure 7A:
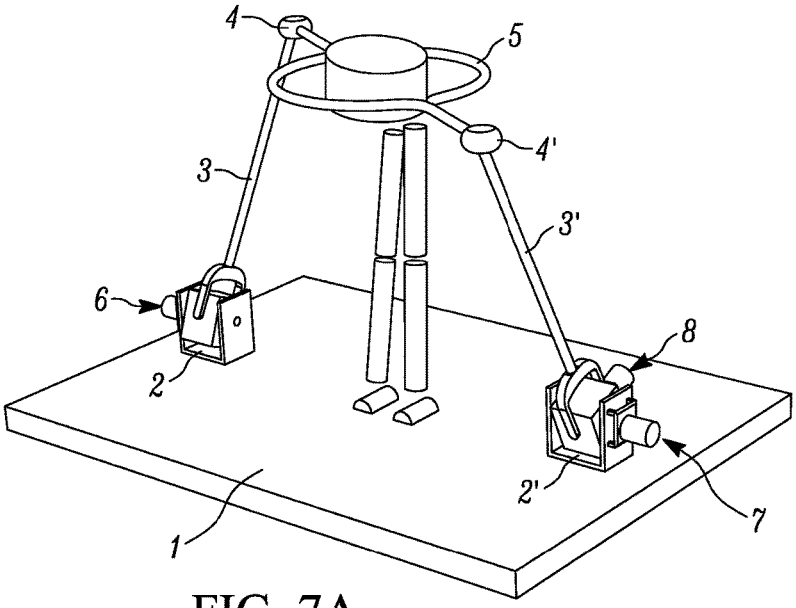
Figure 7B:
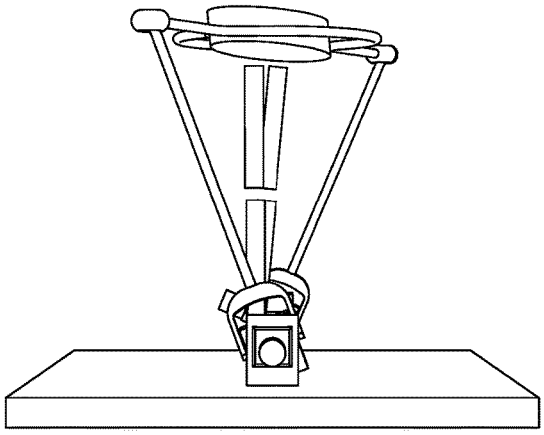
Figure 7C:
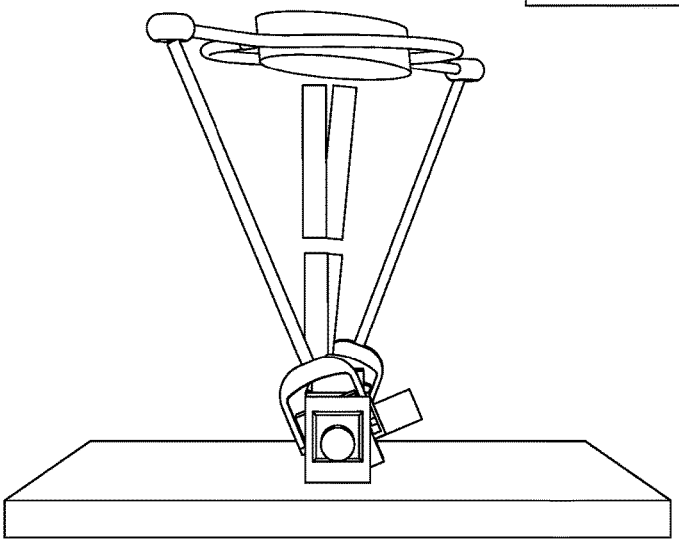
Figure 7D:
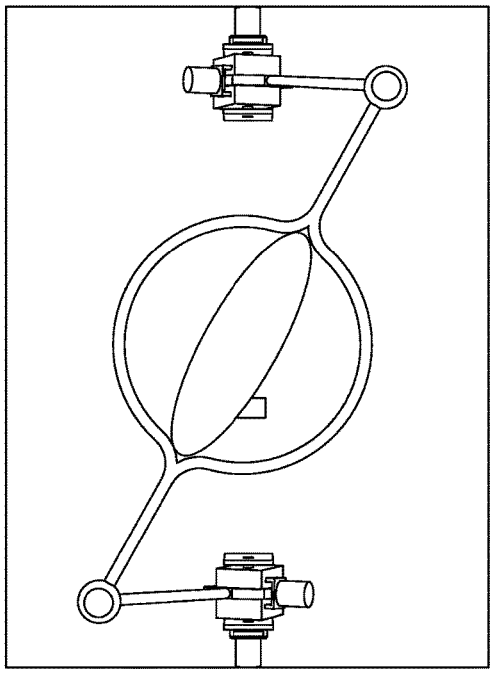
Figure 7E:
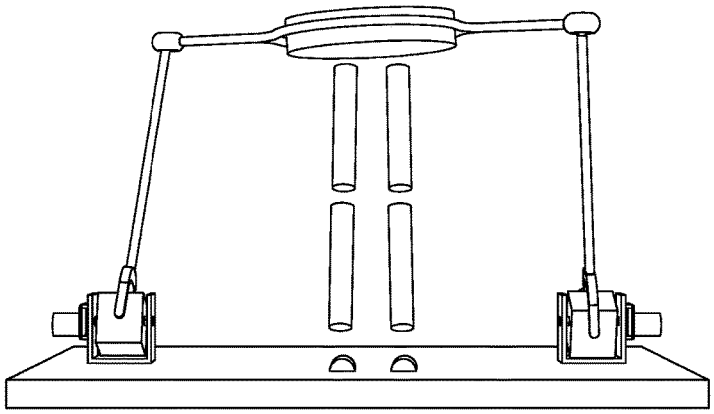
Figure 7F:
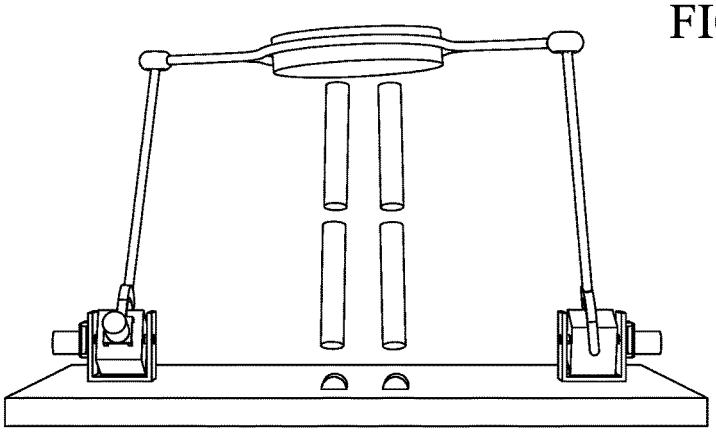
Figure 8A:
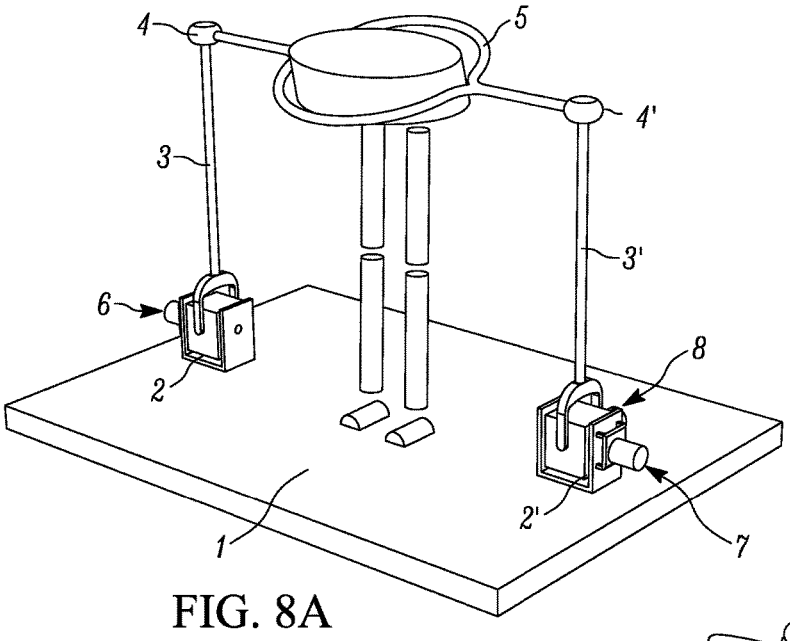
Figure 8B:
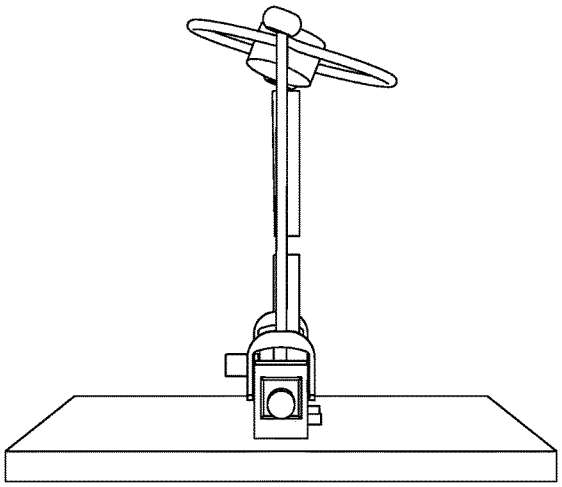
Figure 8C:
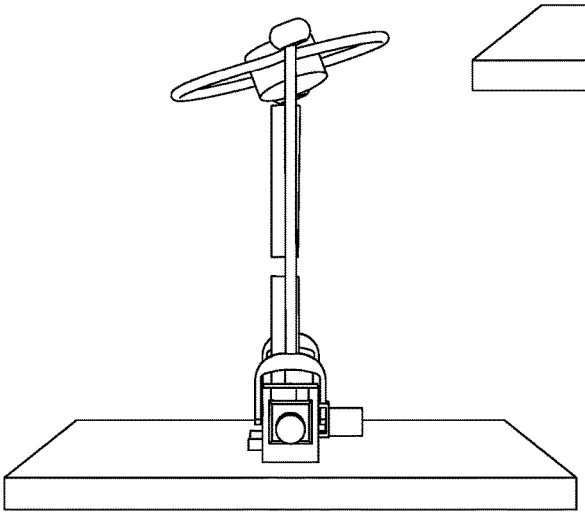
Figure 8D:
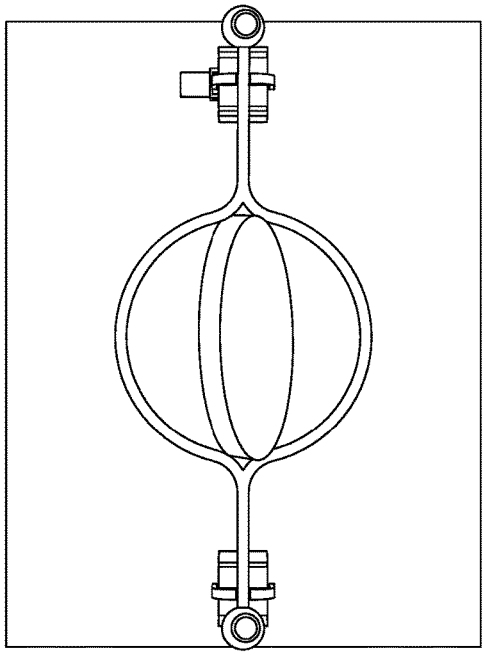
Figure 8E:
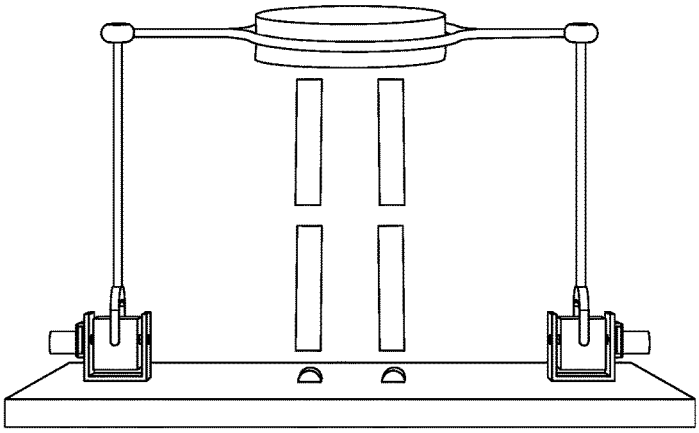
Figure 8F:
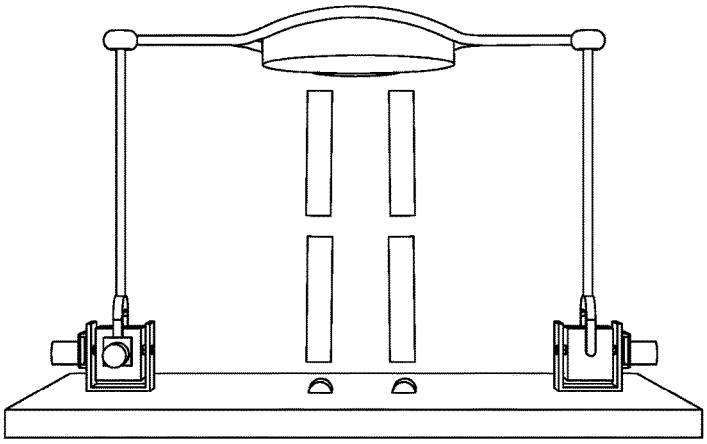
Figure 9A:
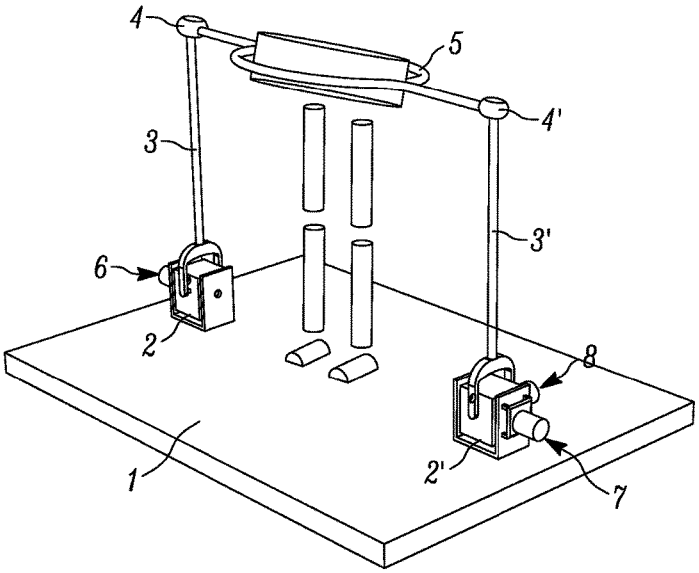
Figure 9B:
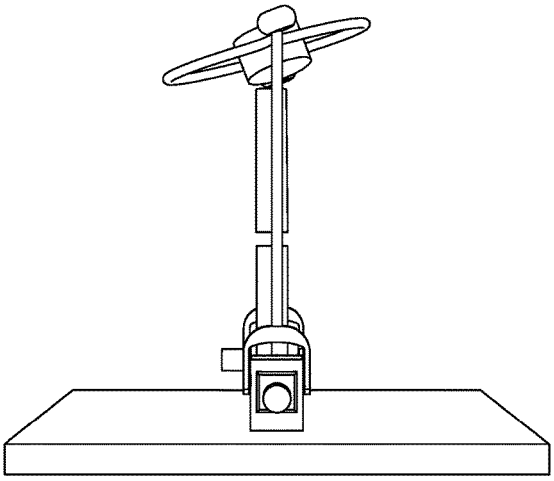
Figure 9C:
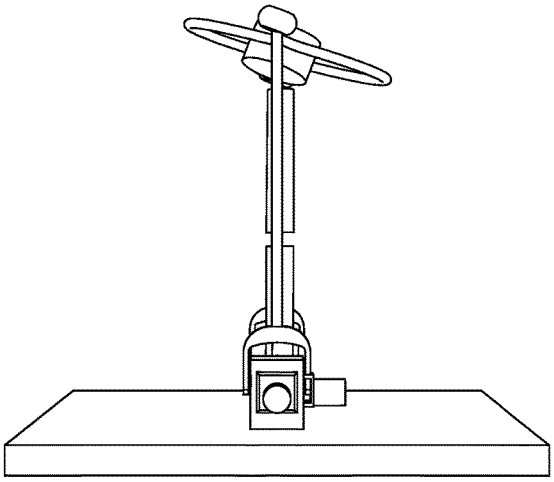
Figure 9D:
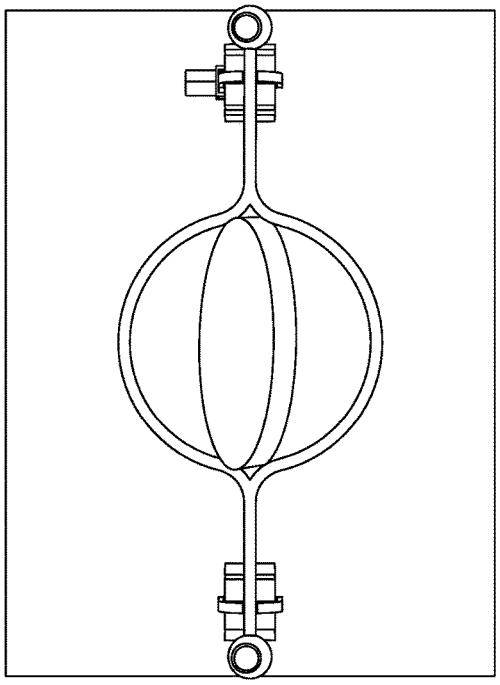
Figure 9E:
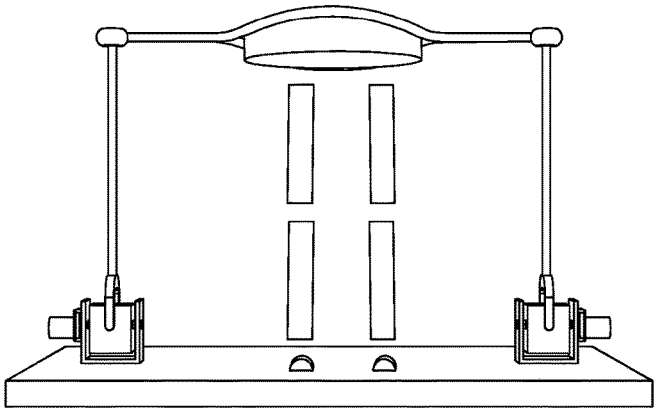
Figure 9F:
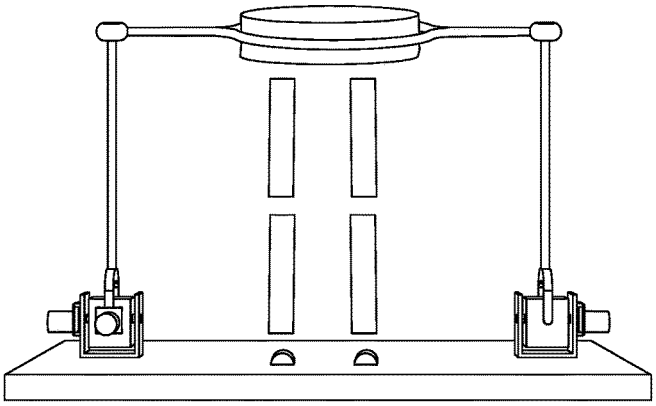
Figure 10A:
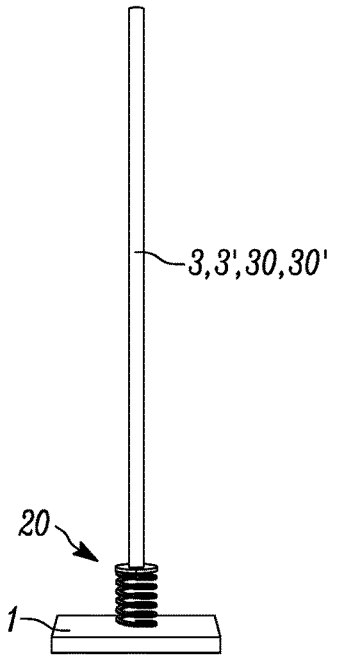
Figure 10B:
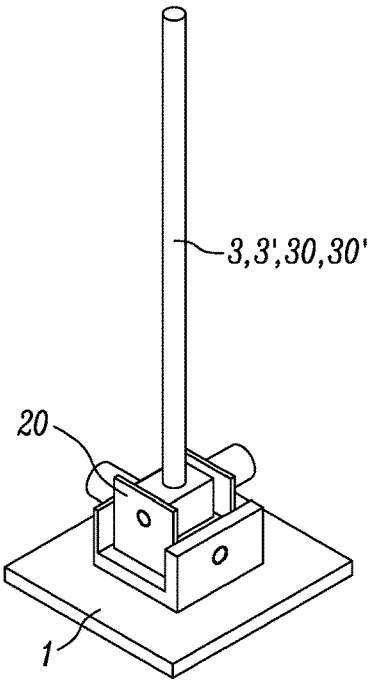
Figure 11:
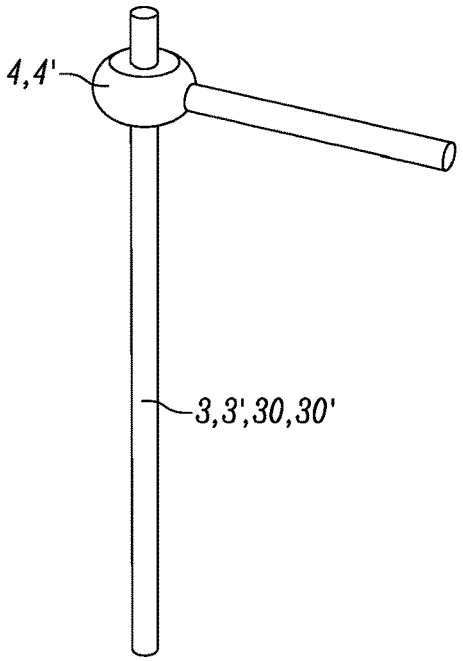
Figure 12A:
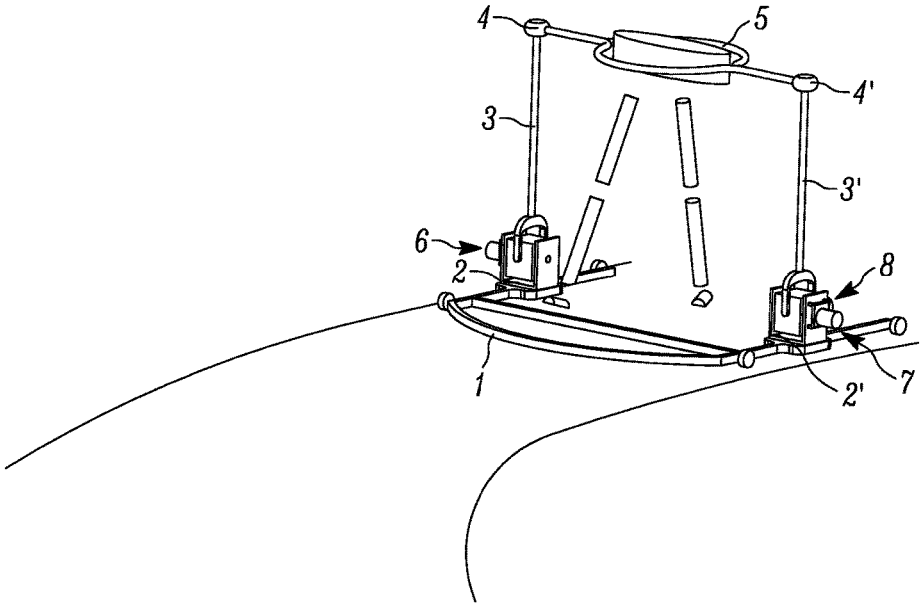
Figure 12B:
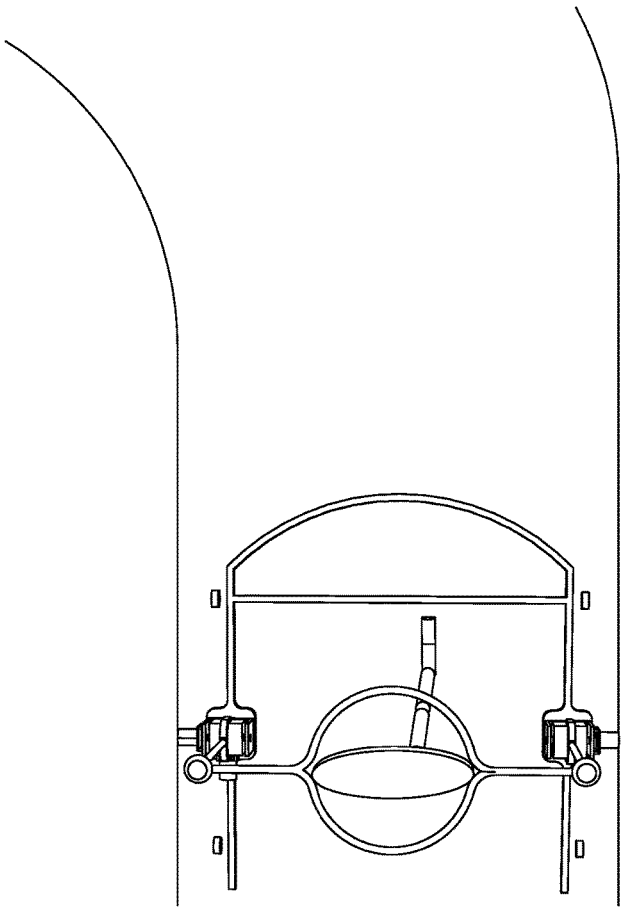
Figure 12C:
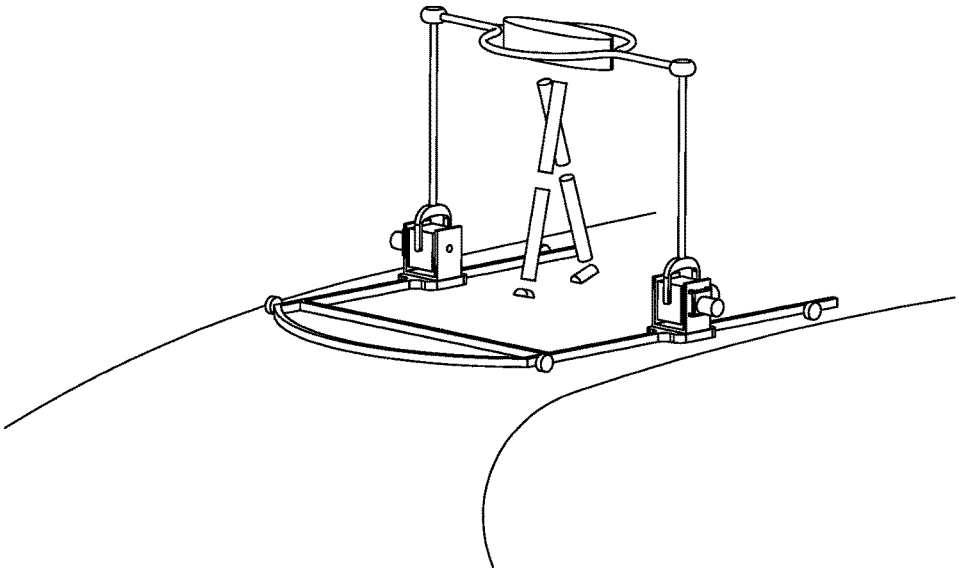
Figure 12D:
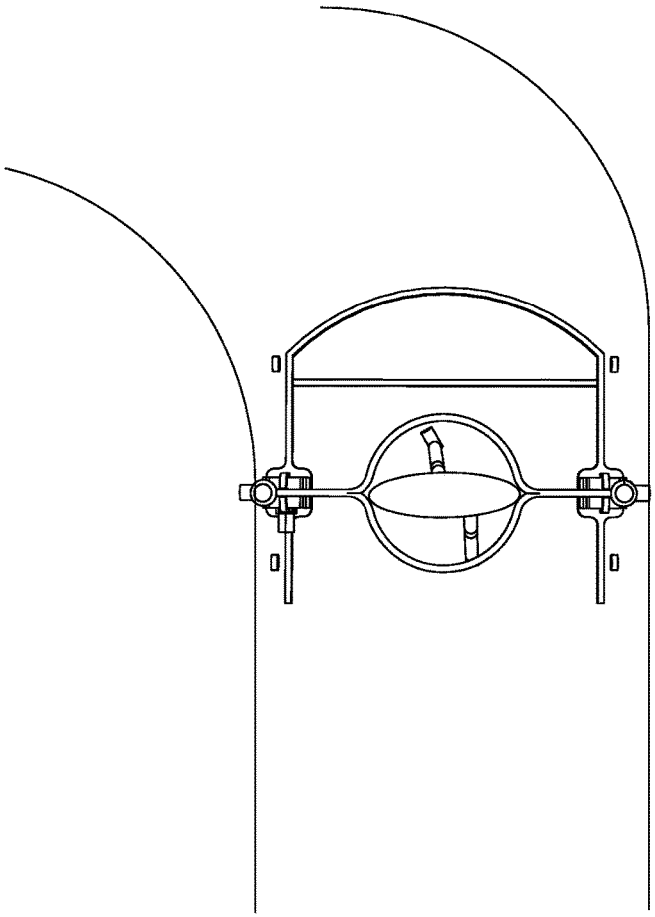
Figure 12E:
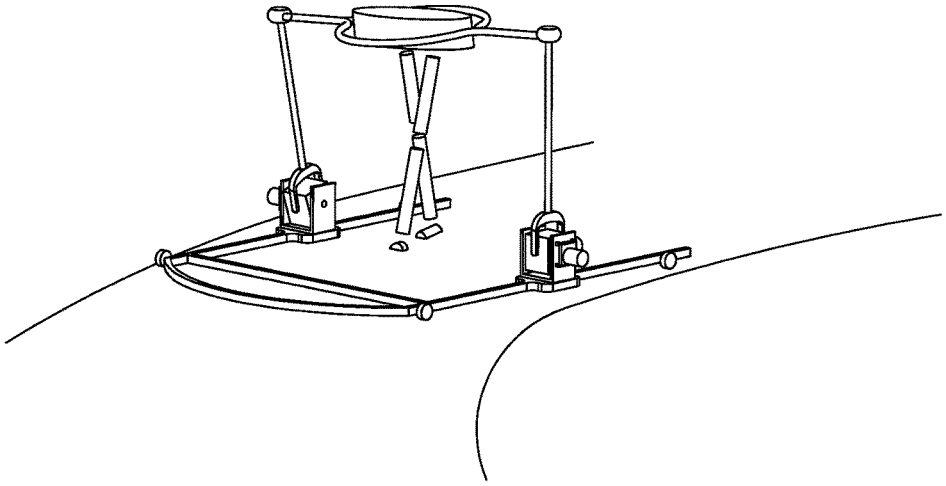
Figure 12F:
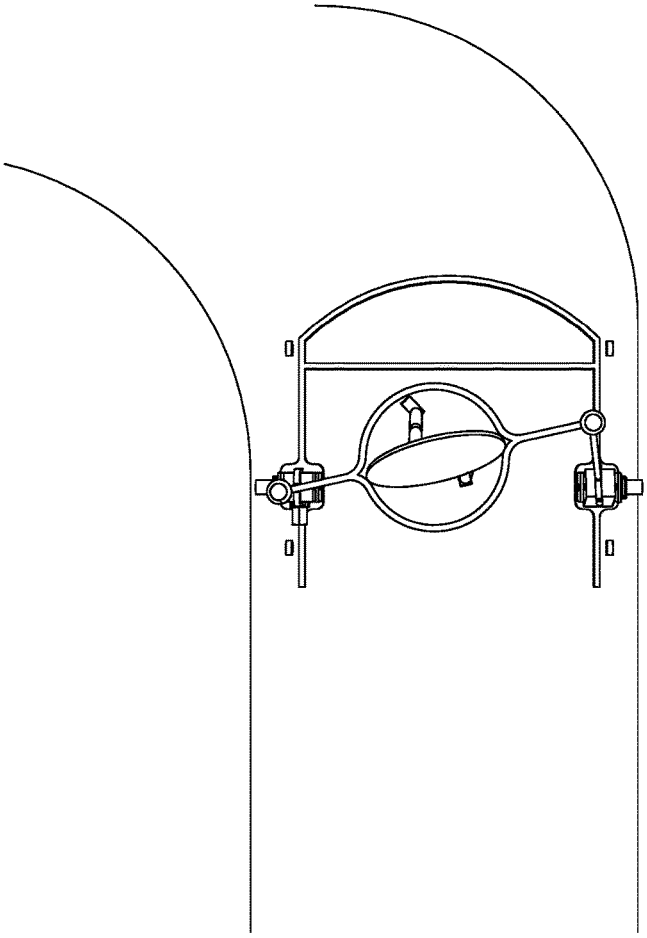
Figure 12G:
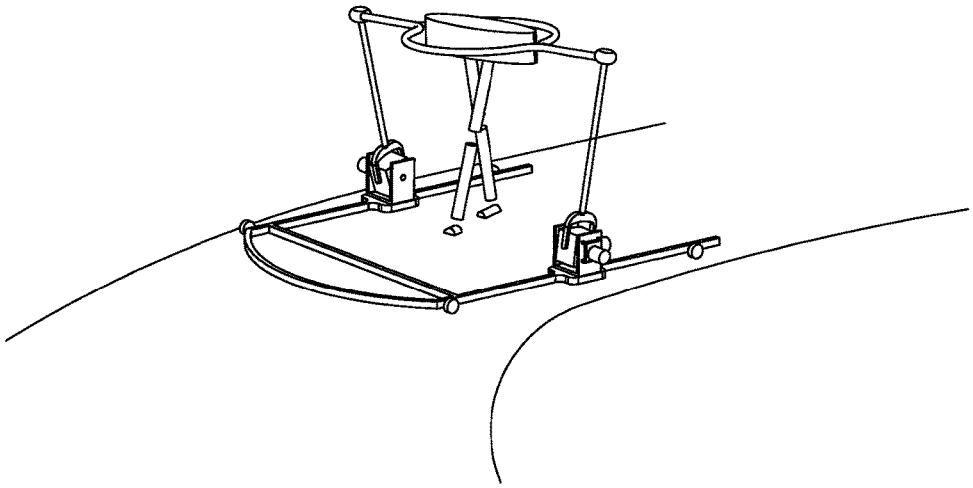
Figure 12H:
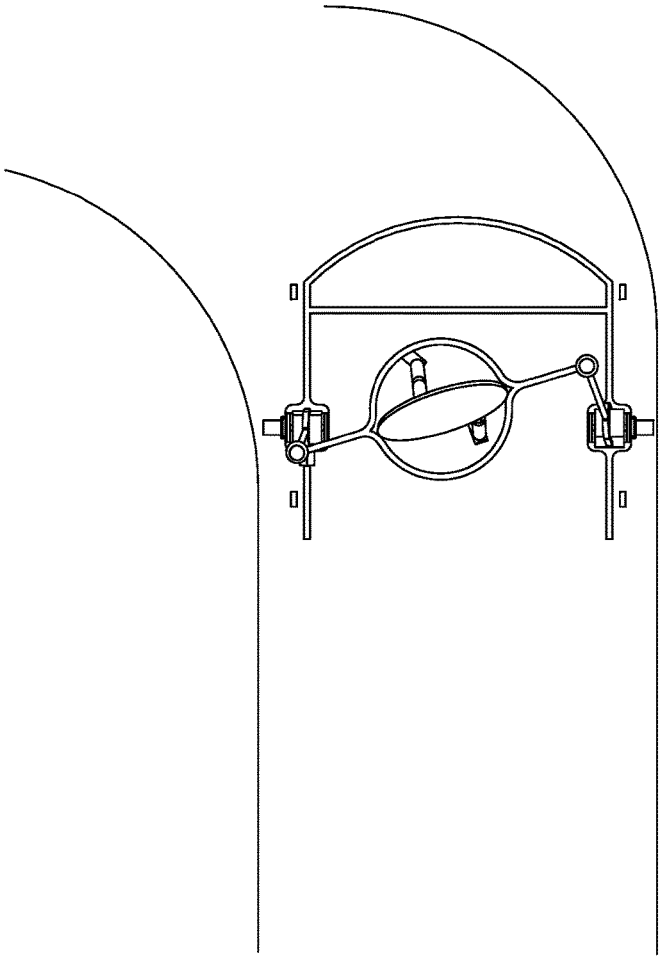
Figure 12I:
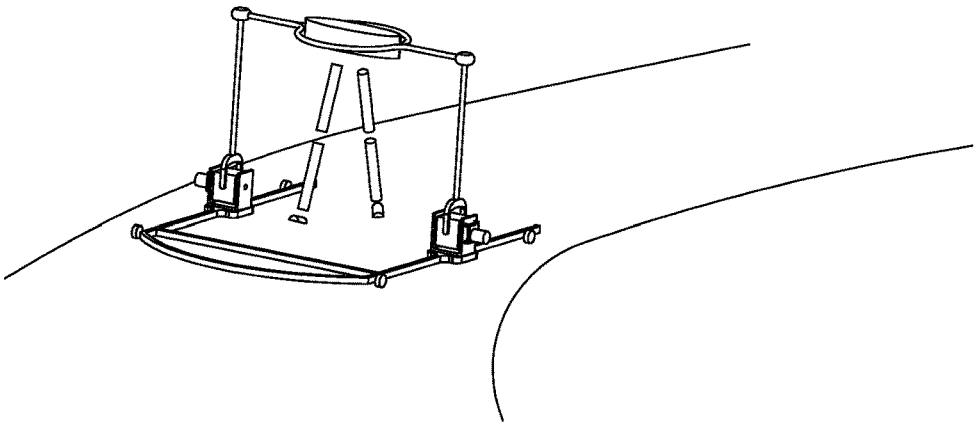
Figure 12J:
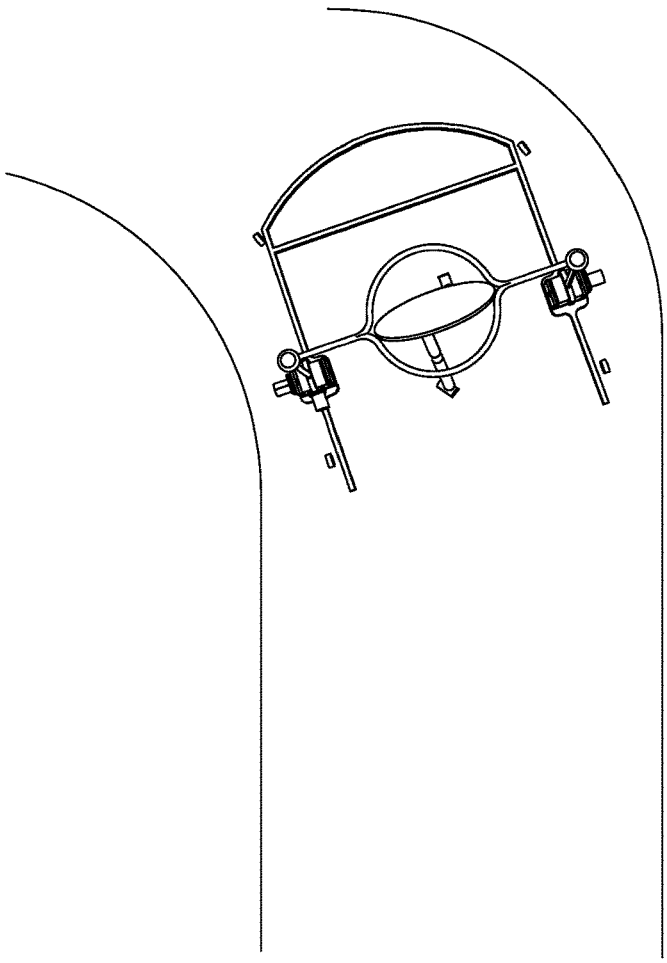
Figure 13A:
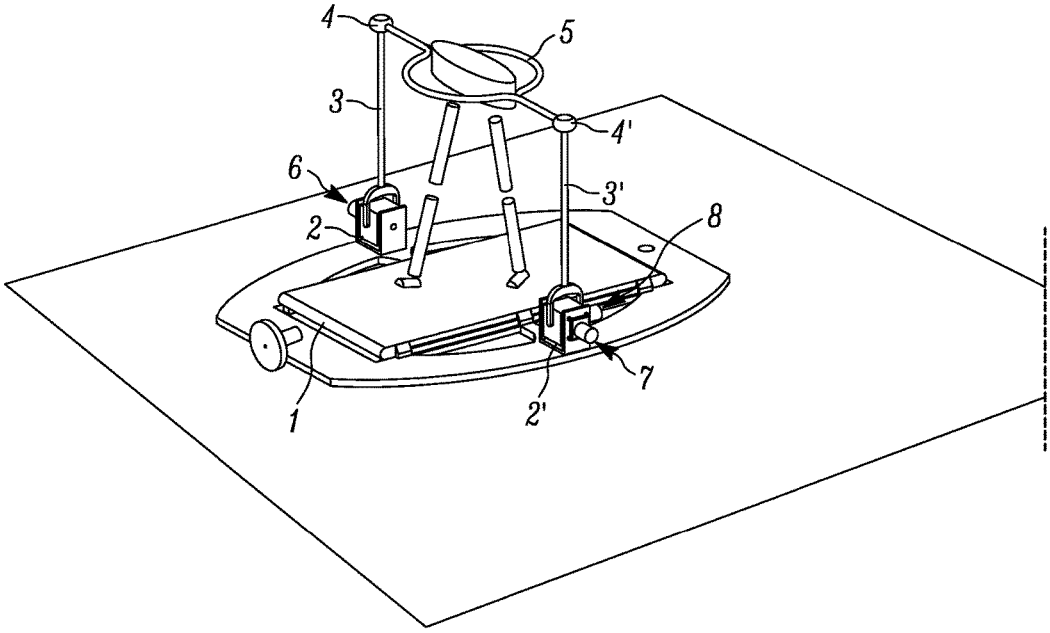
Figure 13B:
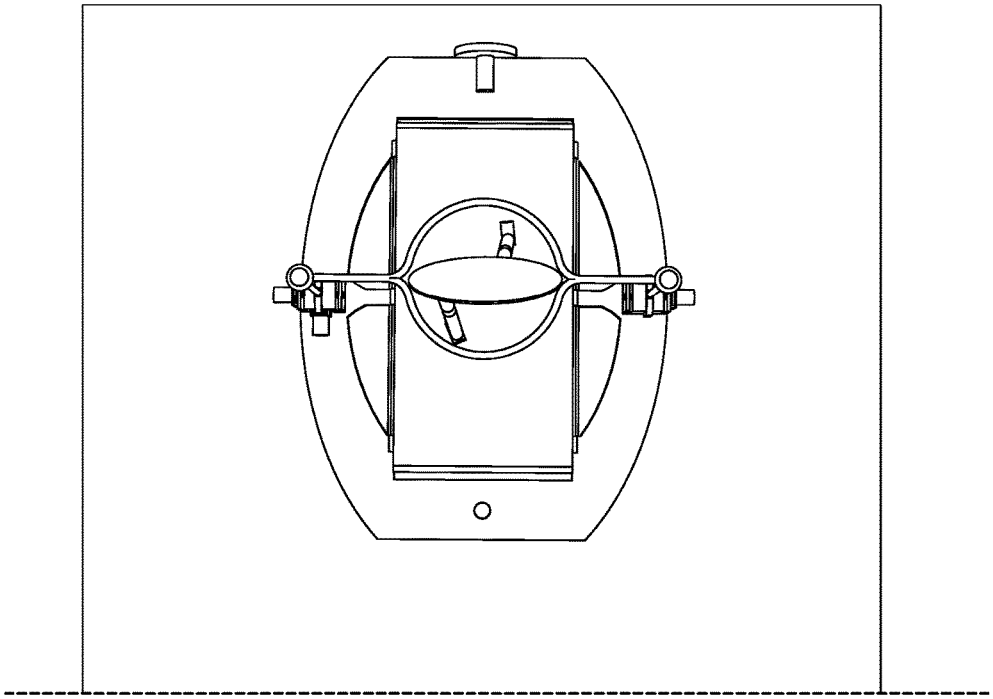
Figure 13C:
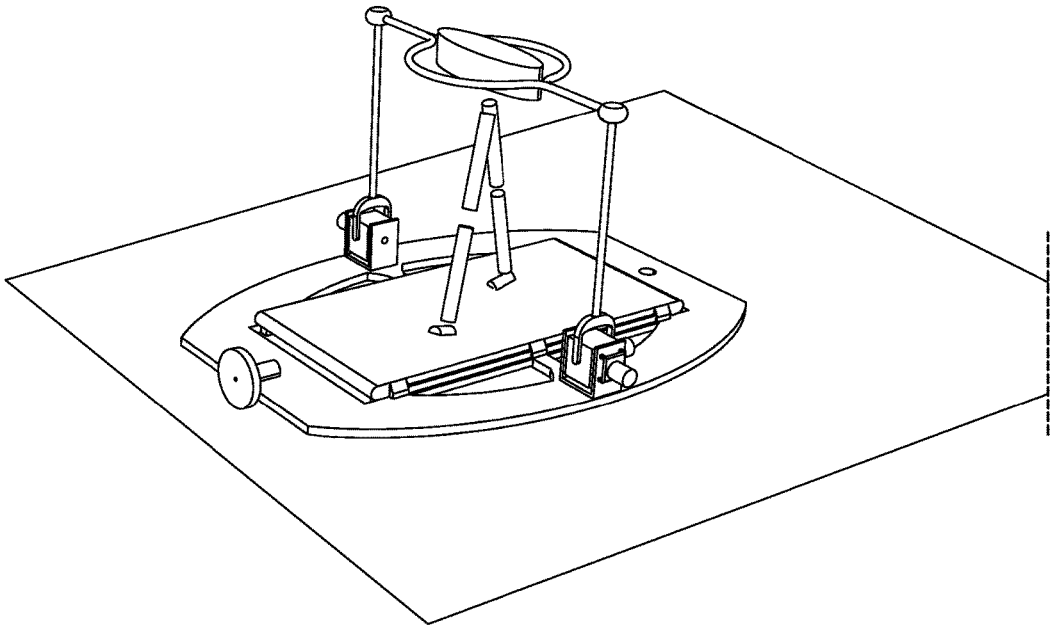
Figure 13D:
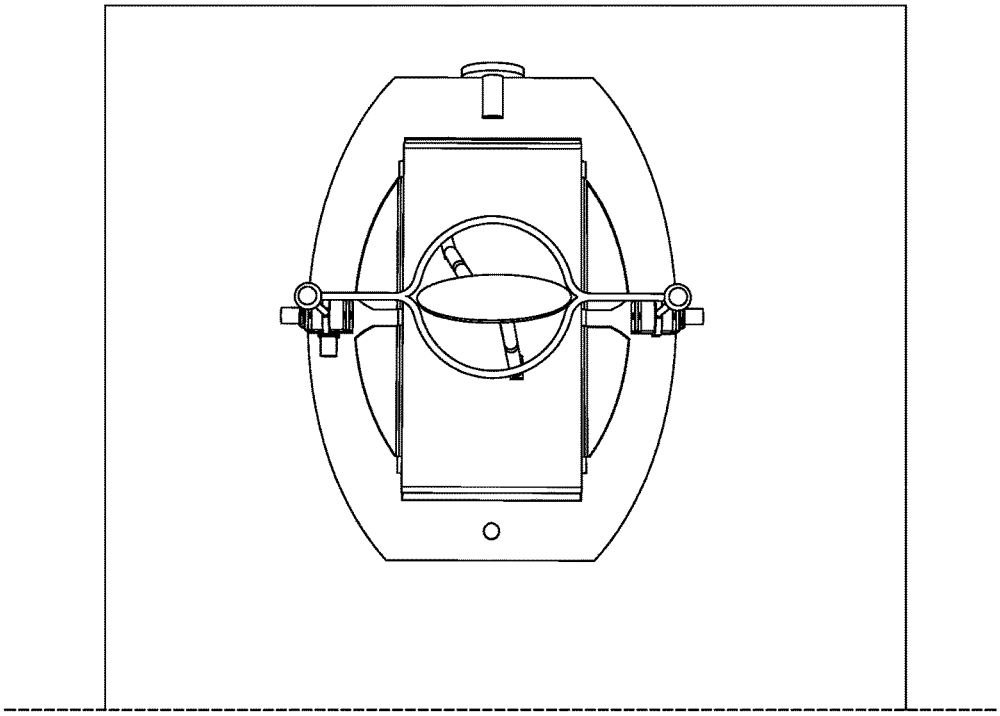
Figure 13E:
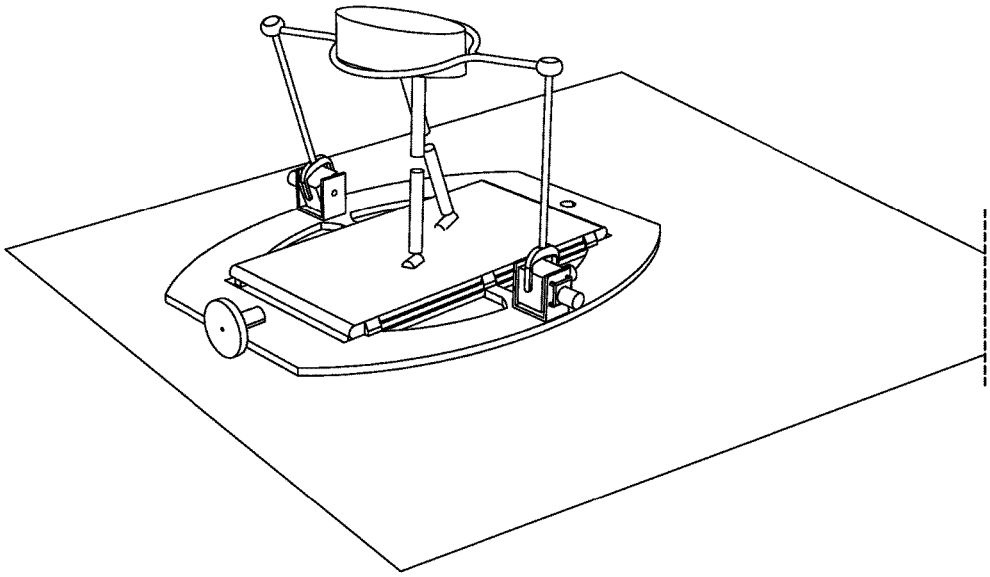
Figure 13F:
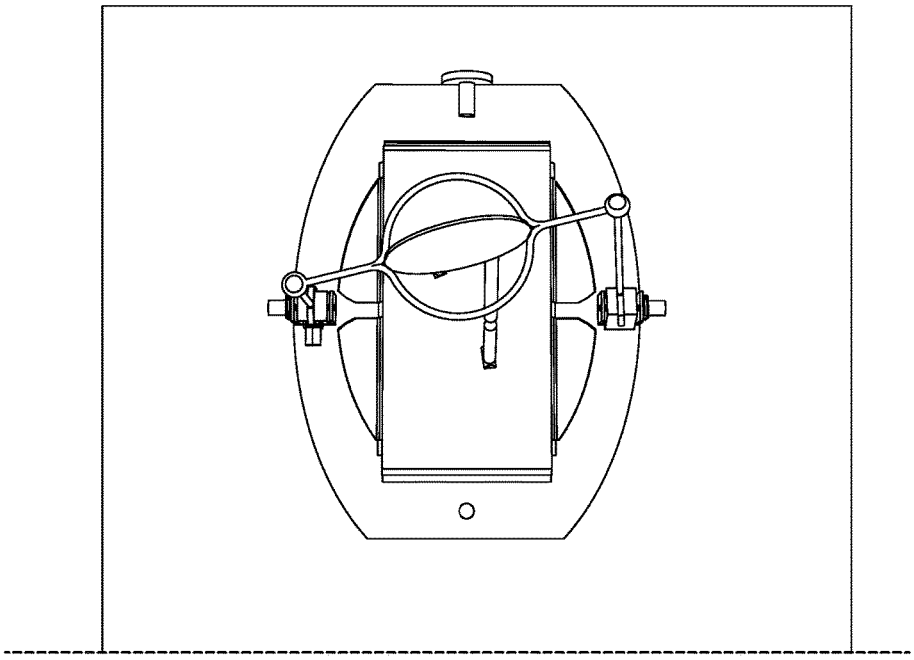
Figure 13G:
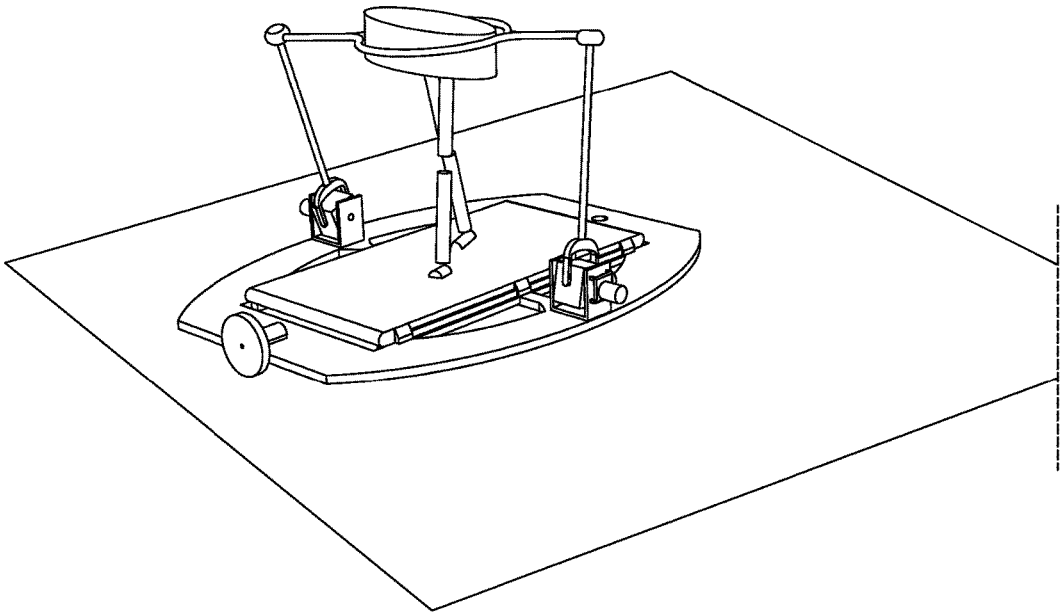
Figure 13H:
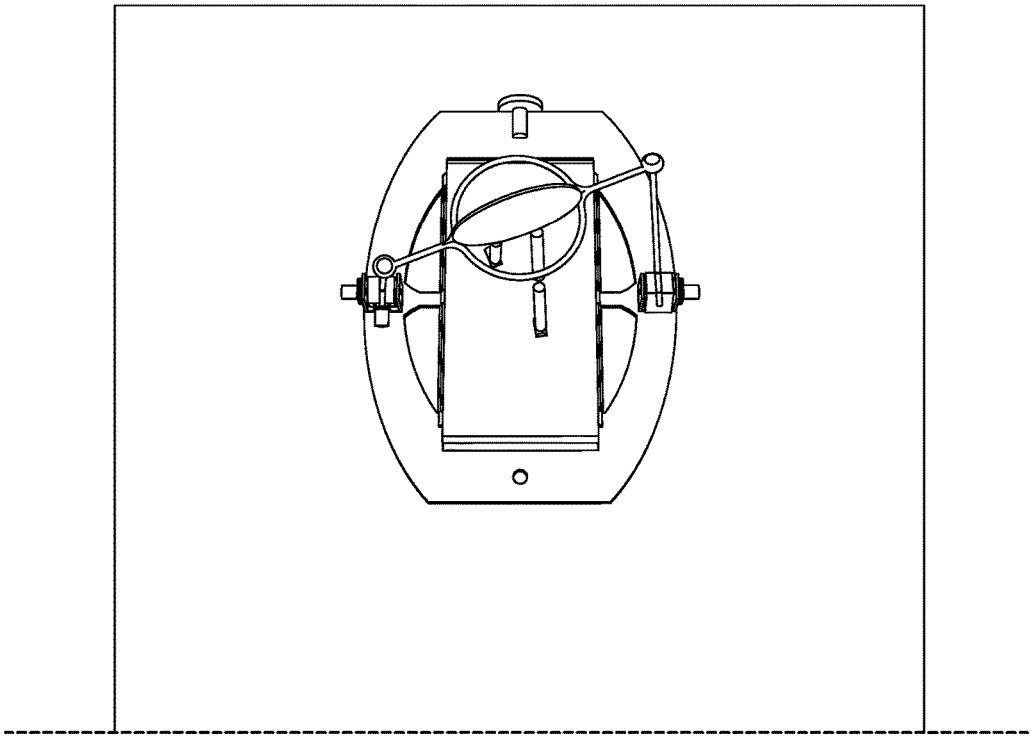
Figure 13I:
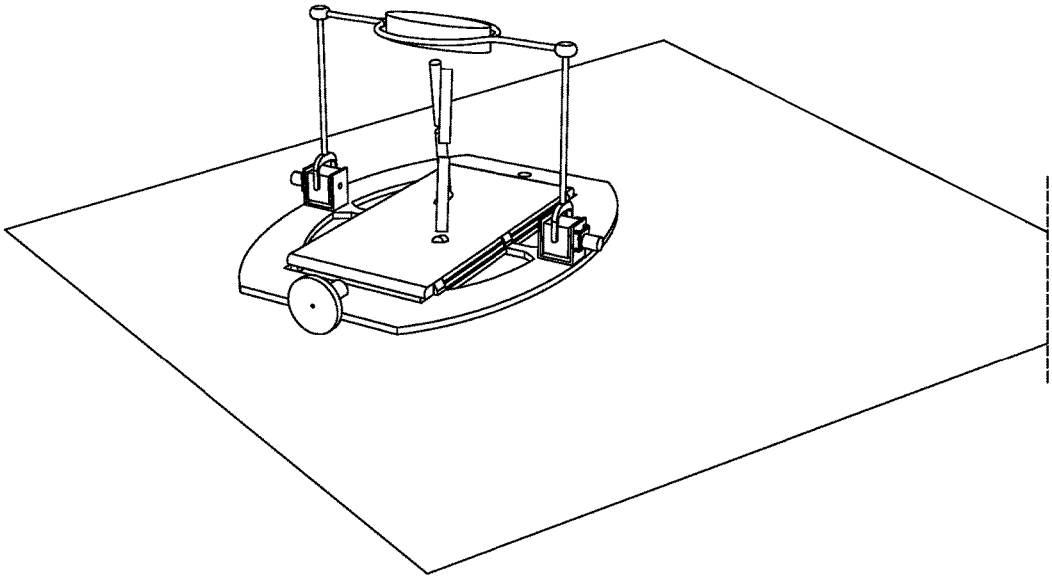
Figure 13J:
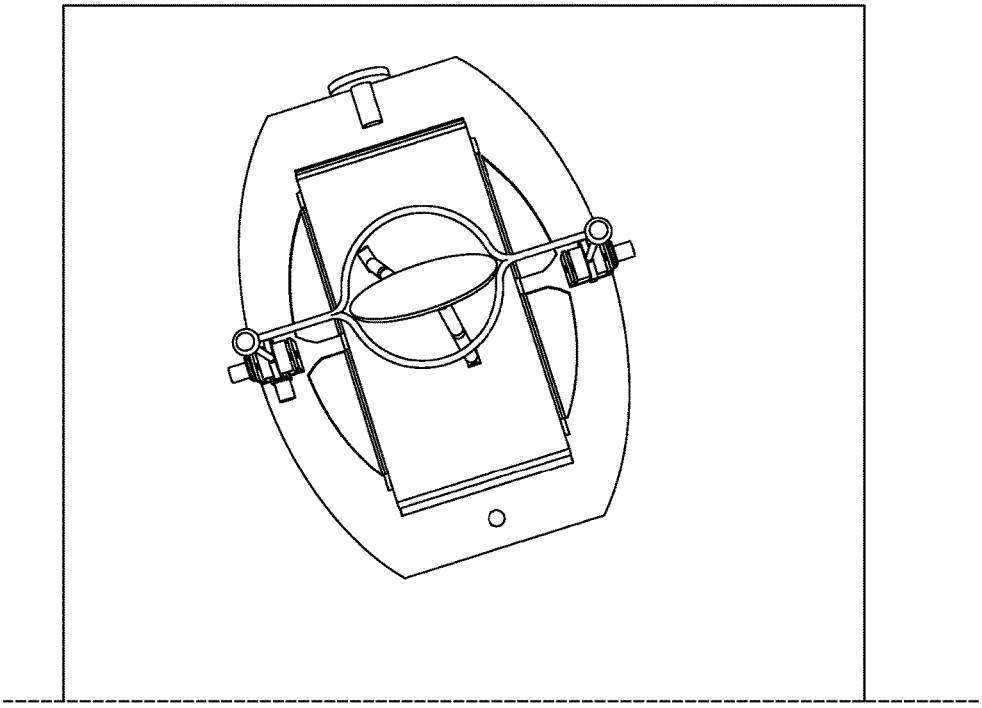
Figure 13K:
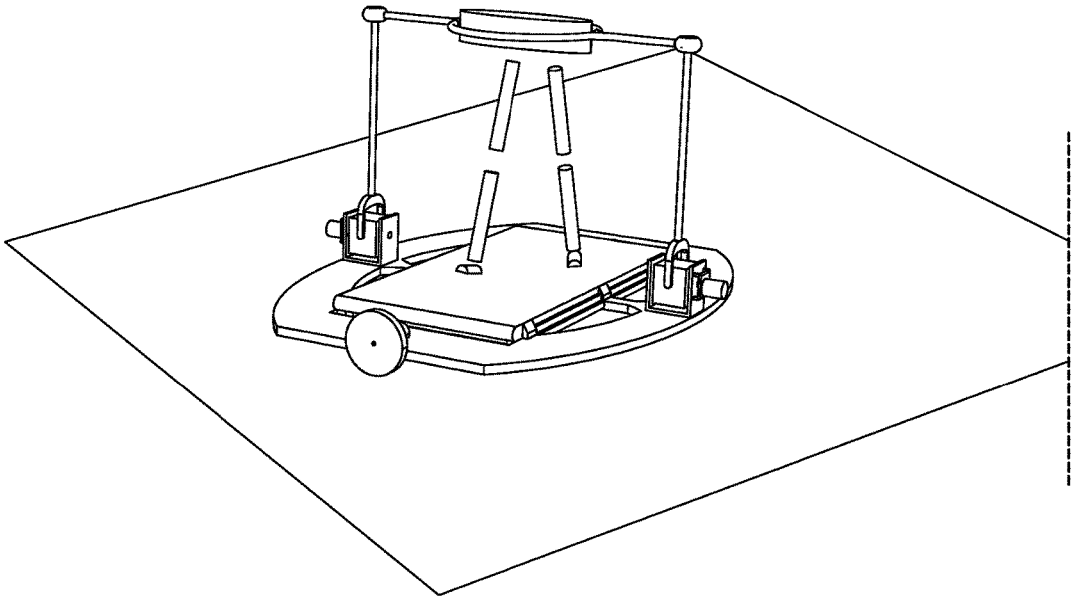
Figure 13L:
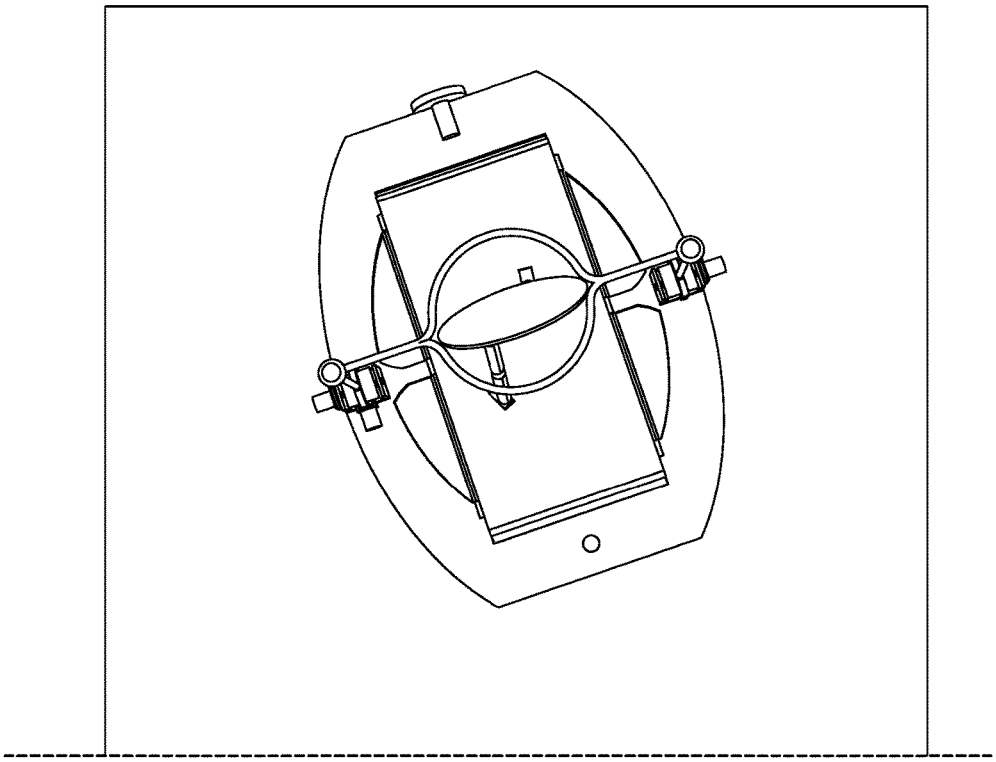
Figure 14A:
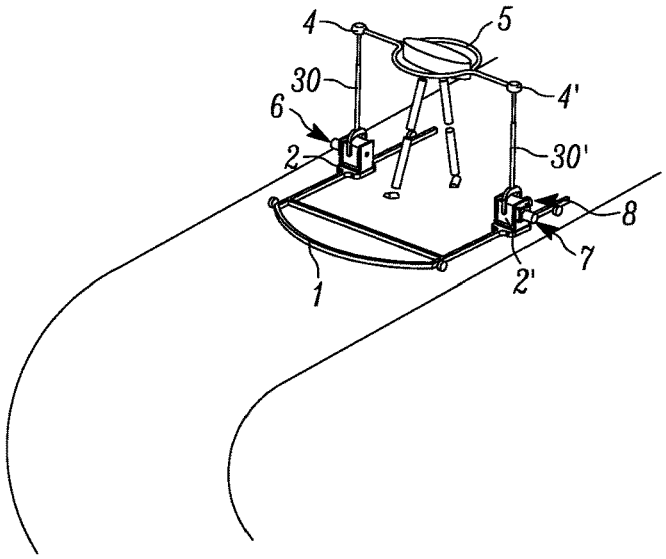
Figure 14B:
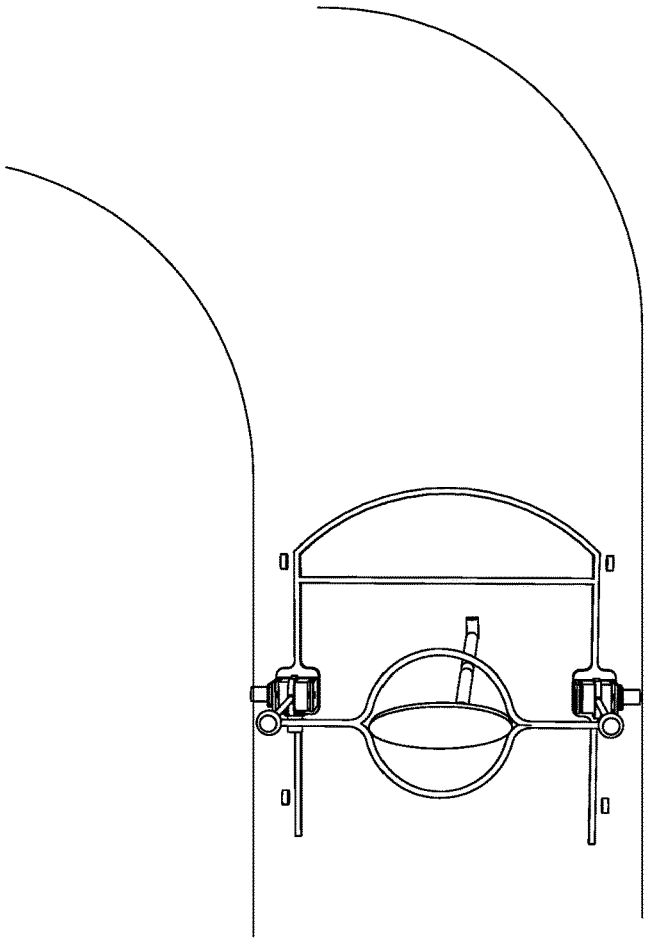
Figure 14C:
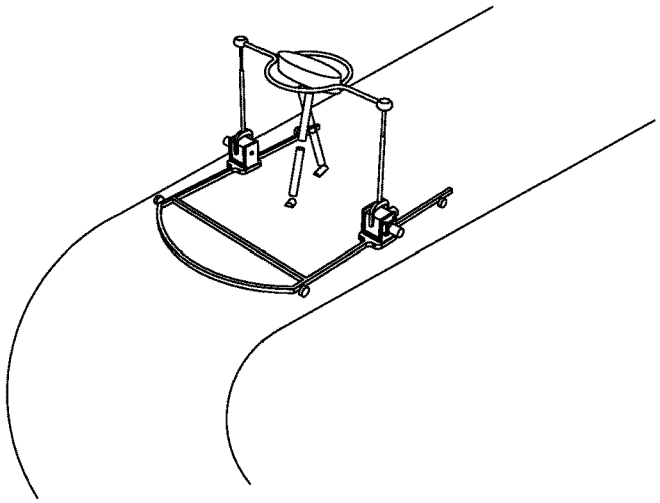
Figure 14D:
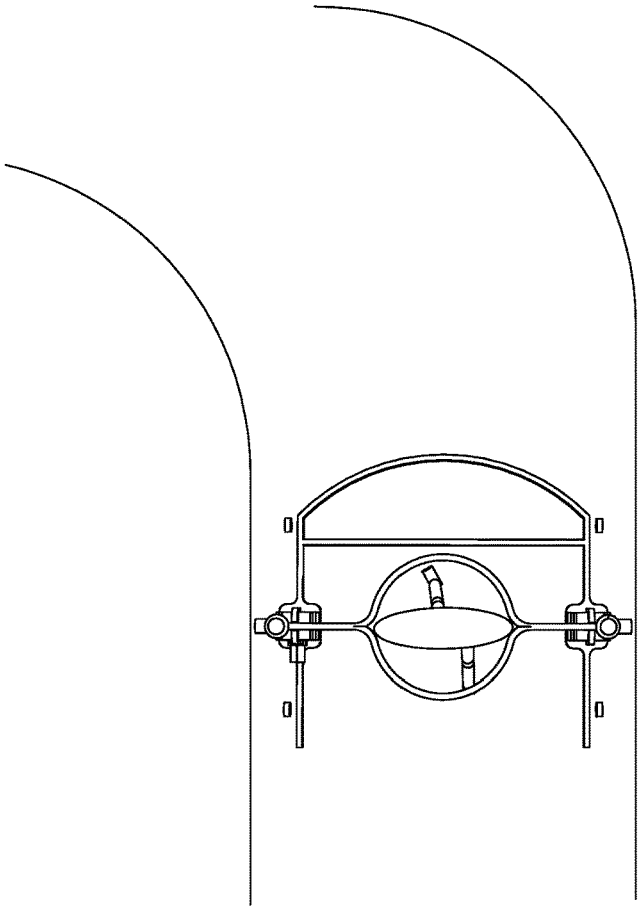
Figure 14E:
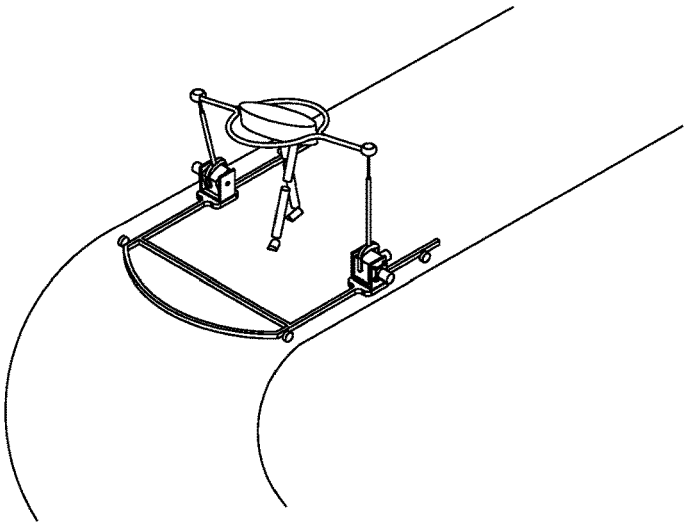
Figure 14F:
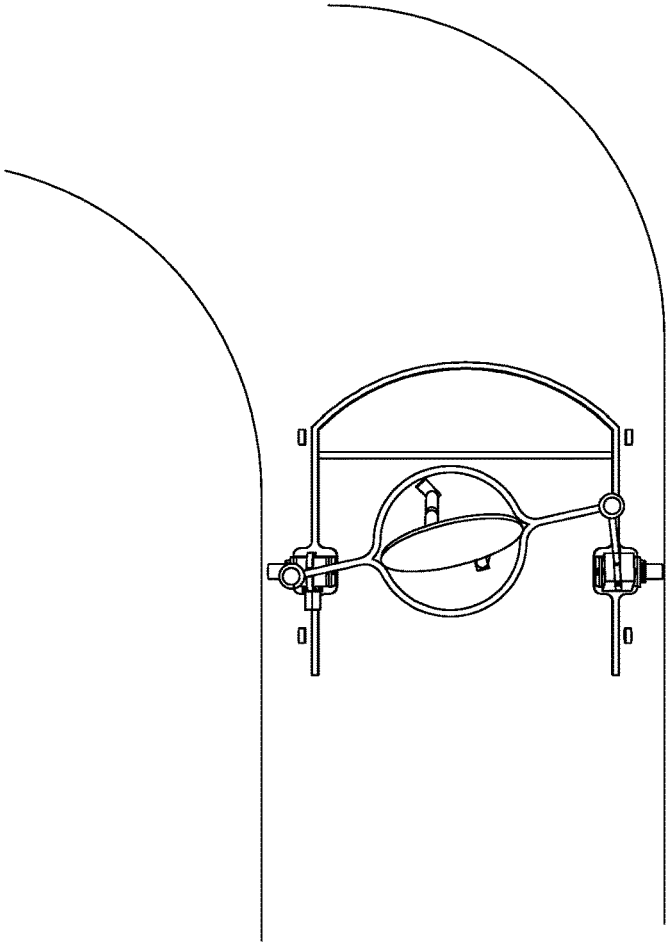
Figure 14G:
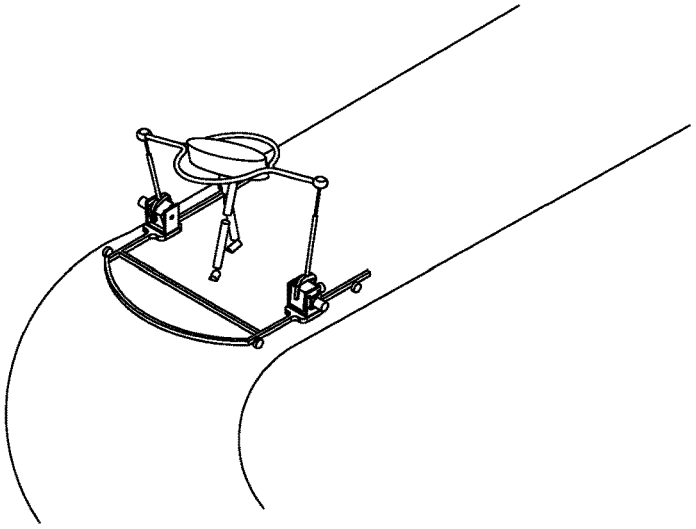
Figure 14H:
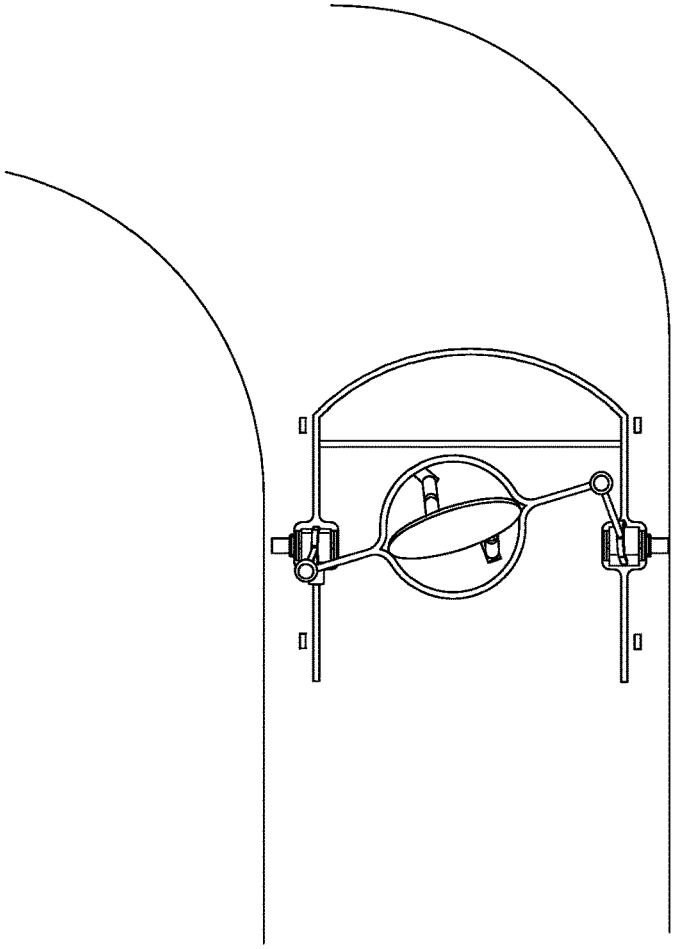
Figure 14I:
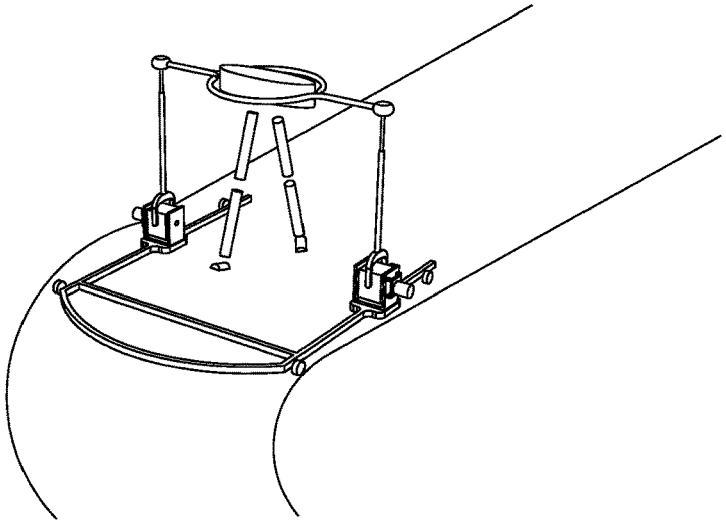
Figure 14J:
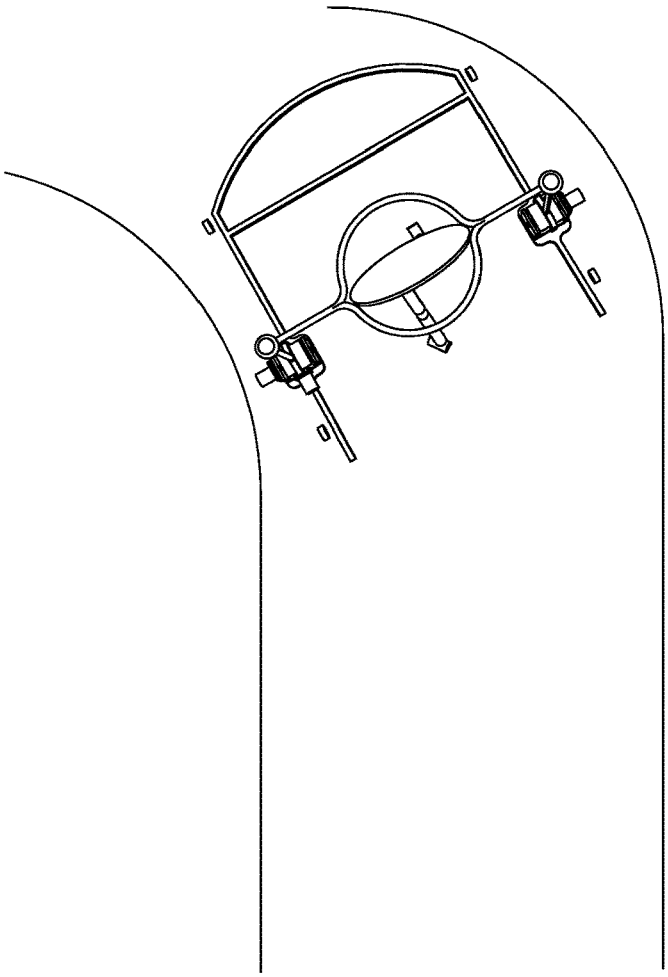
Figure 15A:
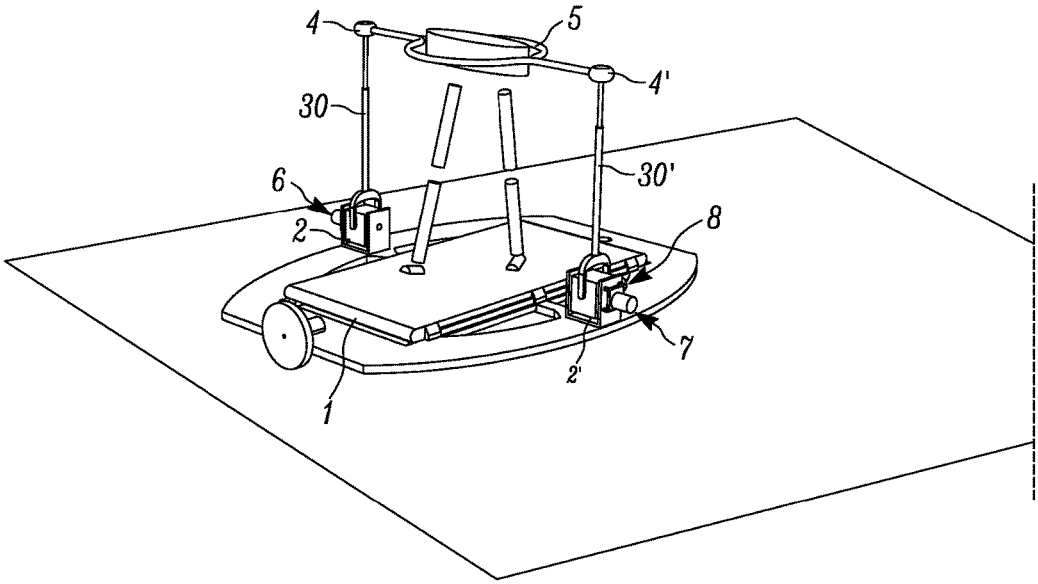
Figure 15B:
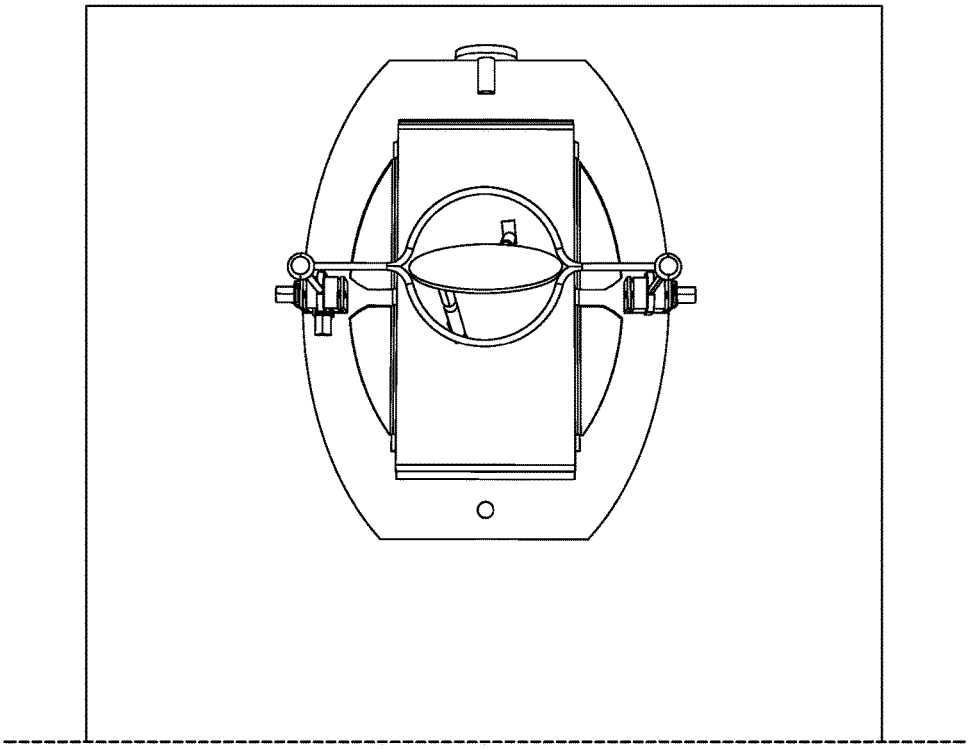
Figure 15C:
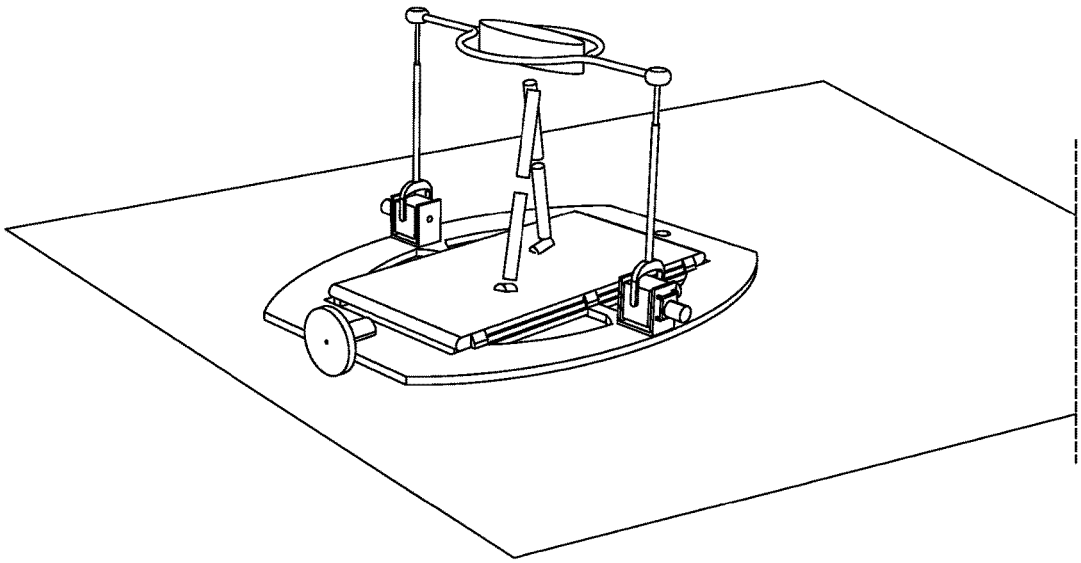
Figure 15D:
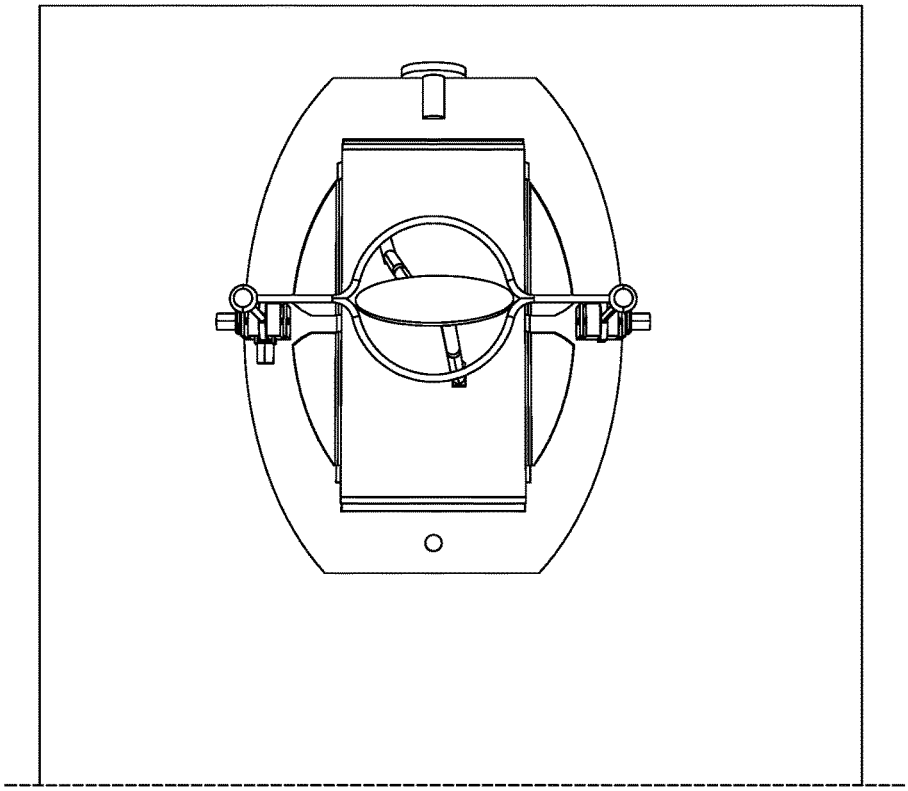
Figure 15E:
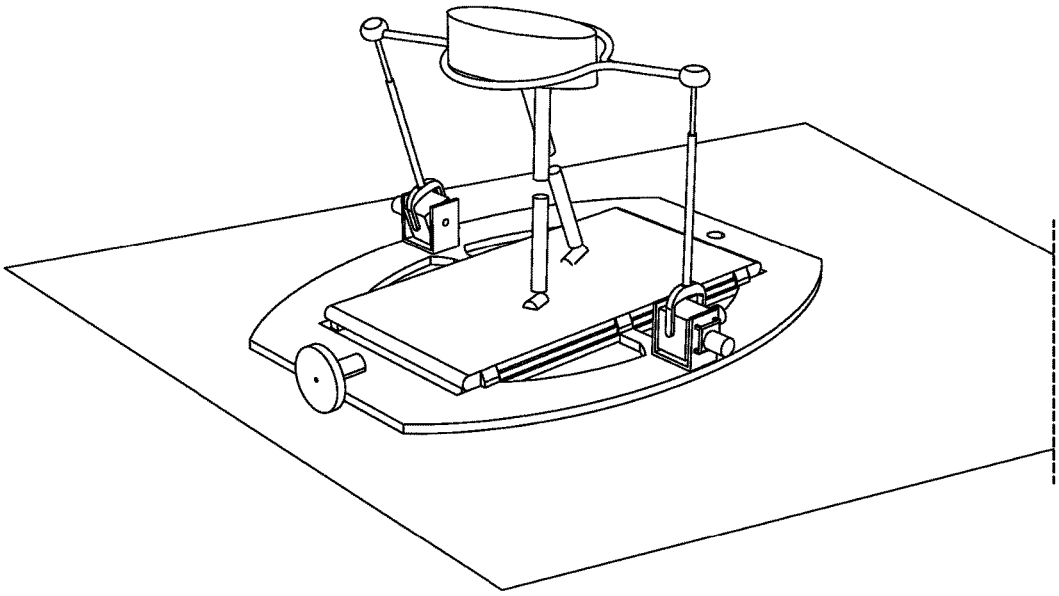
Figure 15F:
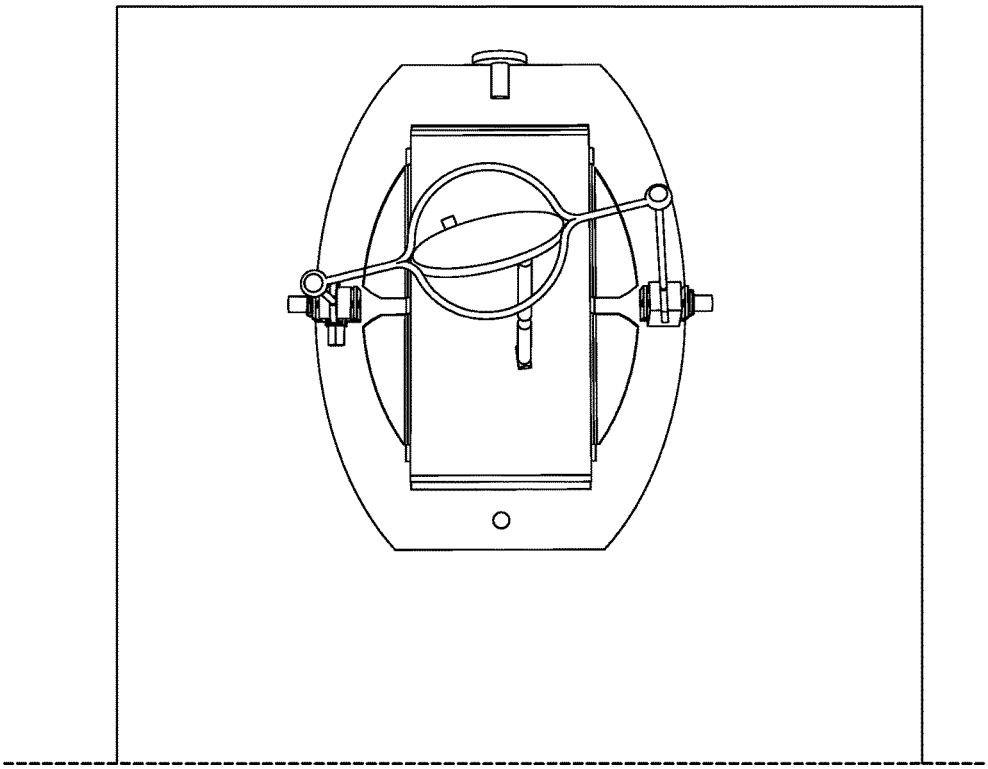
Figure 15G:
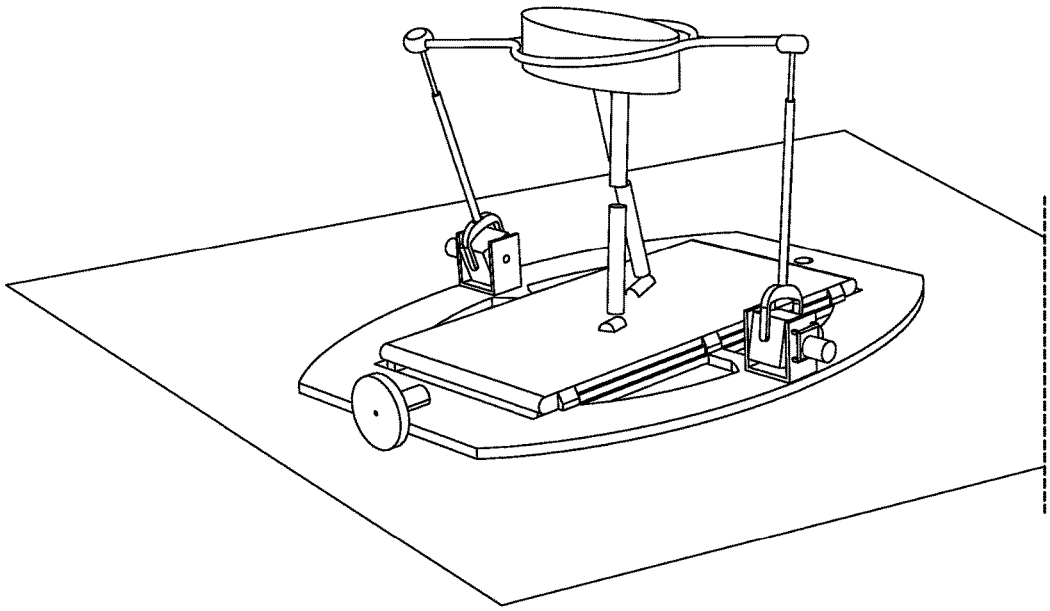
Figure 15H:
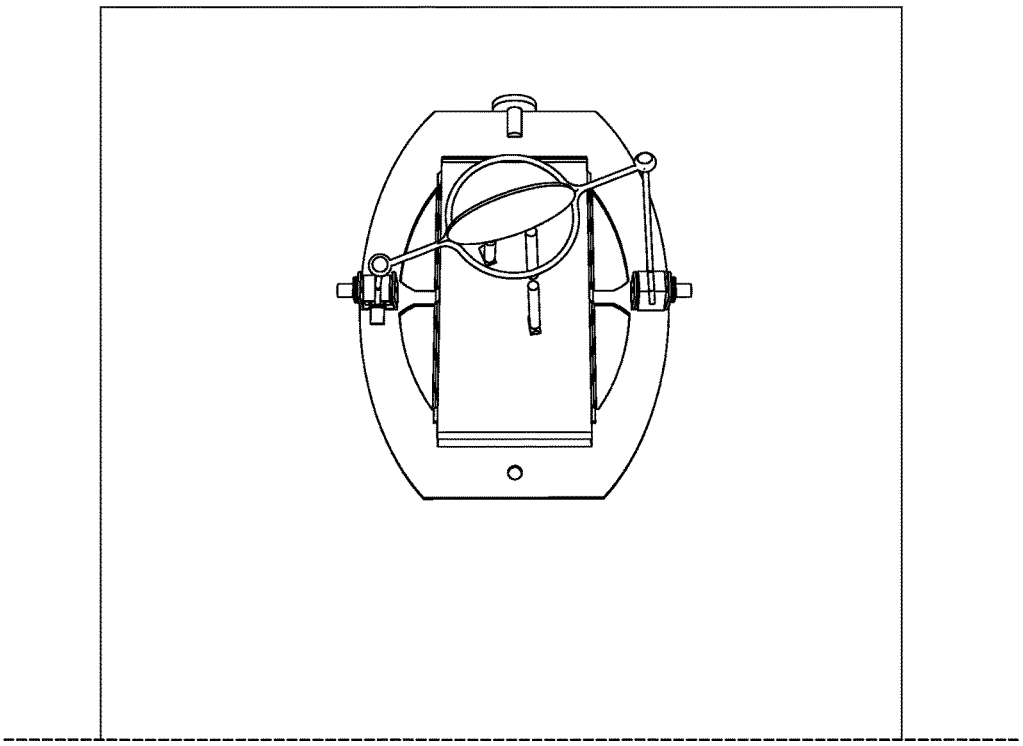
Figure 15I:
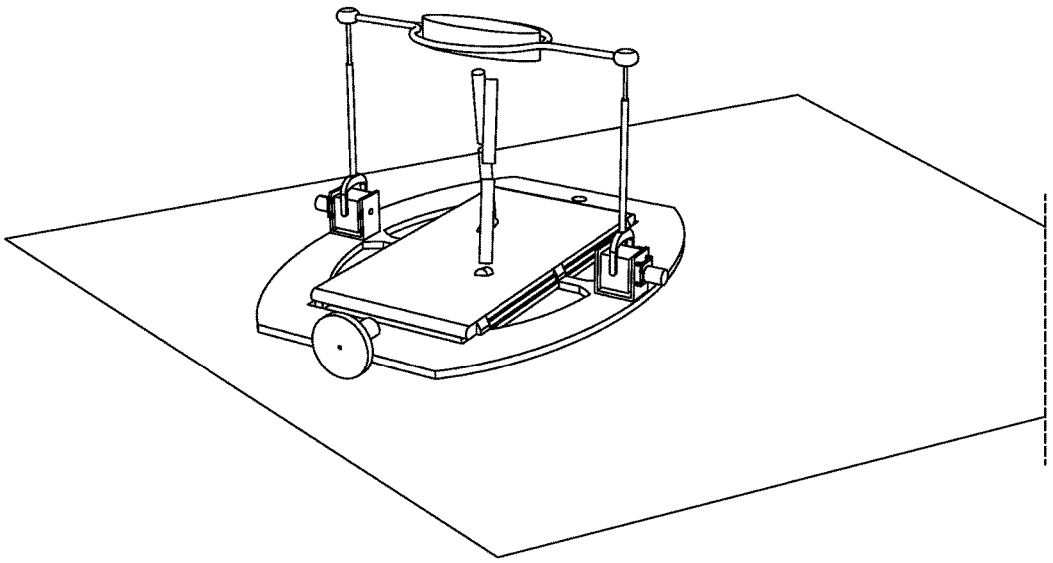
Figure 15J:
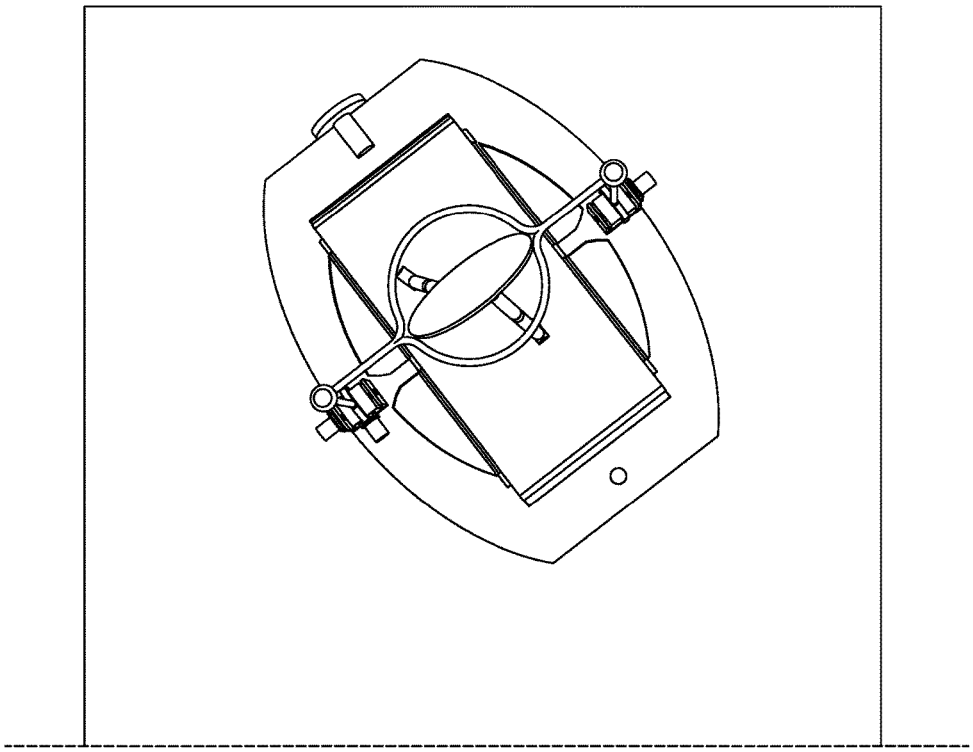
Figure 15K:
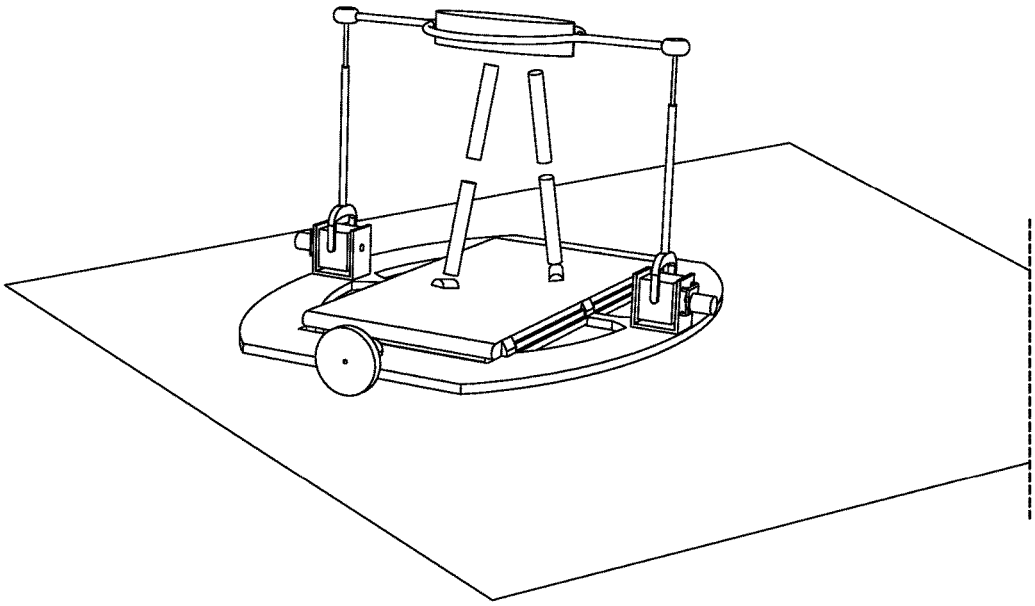
Figure 15L:
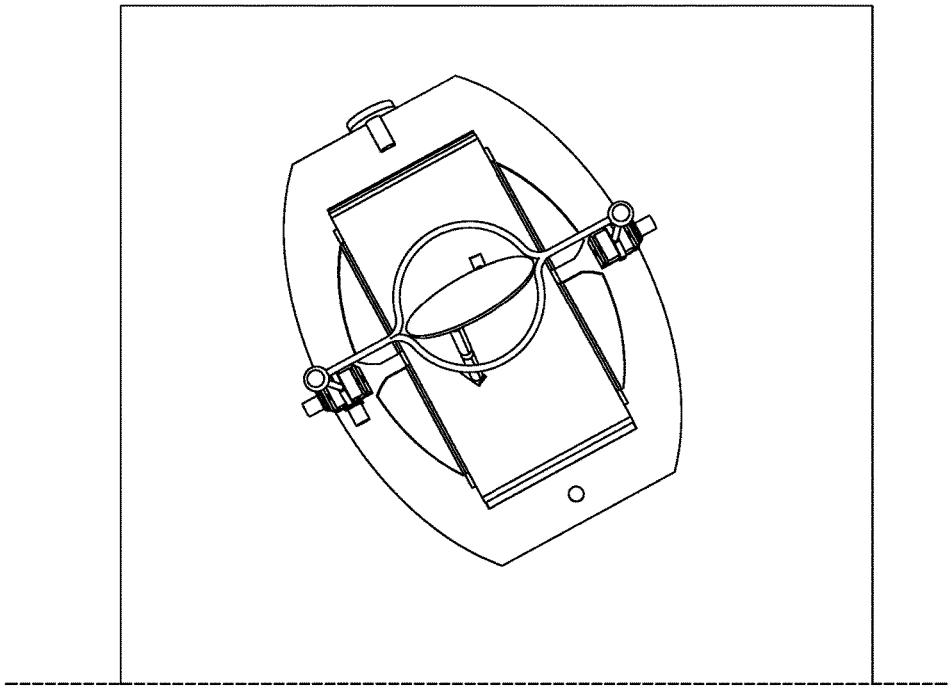

The invention will be described in more detail by way of an embodiment and figures, in which:

FIGS. 1A-1F, hereinafter collectively referred to as FIG. 1, shows a schematic demonstration of the apparatus of the invention and the first embodiment;

FIGS. 2A-2F, hereinafter collectively referred to as FIG. 2, shows a schematic demonstration of backward motion of a standing subject in the apparatus of the invention according to the first embodiment;

FIGS. 3A-3F, hereinafter collectively referred to as FIG. 3, shows a schematic demonstration of forward motion of a standing subject in the apparatus of the invention according to the first embodiment;

FIGS. 4A-4F, hereinafter collectively referred to as FIG. 4, shows a schematic demonstration of motion of a standing subject to the left in the apparatus of the invention according to the first embodiment;

FIGS. 5-5F, hereinafter collectively referred to as FIG. 5, shows a schematic demonstration of motion of a standing subject to the right in the apparatus of the invention according to the first embodiment;

FIGS. 6A-6F, hereinafter collectively referred to as FIG. 6, shows a schematic demonstration of a standing subject rotating to the left around a vertical axis in a transversal plane in the apparatus of the invention according to the first embodiment;

FIGS. 7A-7F, hereinafter collectively referred to as FIG. 7, shows a schematic demonstration of a standing subject rotating to the right around a vertical axis in a transversal plane in the apparatus of the invention according to the first embodiment;

FIGS. 8A-8F, hereinafter collectively referred to as FIG. 8, shows a schematic demonstration of a passive tilt of the pelvis of a standing subject forward in the apparatus of the invention according to the first embodiment;

FIGS. 9A-9F, hereinafter collectively referred to as FIG. 9, shows a schematic demonstration of a passive tilt of the pelvis of a standing subject backwards in the apparatus of the invention according to the first embodiment;

FIGS. 10A-10B, hereinafter collectively referred to as FIG. 10, shows a schematic demonstration of possible variants of universal joints of the invention;

FIG. 11 shows a detail of an alternative connection of the vertical rod with the spherical joint;

FIGS. 12A-12J, hereinafter collectively referred to as FIG. 12, shows a schematic demonstration of motion of a subject with the apparatus of the invention, where the base platform is a motorised mobile platform according to the first embodiment;

FIGS. 13A-13L, hereinafter collectively referred to as FIG. 13, shows a schematic demonstration of motion of a subject with the apparatus of the invention, where the base platform is a motorised platform with a treadmill according to the first embodiment;

FIGS. 14A-14J, hereinafter collectively referred to as FIG. 14, shows a schematic demonstration of motion of a subject with the apparatus of the invention, where the base platform is a motorised mobile platform according to the second embodiment;

FIGS. 15A-15L, hereinafter collectively referred to as FIG. 15, shows a schematic demonstration of motion of a subject with the apparatus of the invention, where the base platform is a motorised platform with a treadmill according to the second embodiment.

FIG. 1 is a schematic demonstration of a lower body part of a standing subject who is supported in the pelvis area by the apparatus of the invention according to the first embodiment; the apparatus allows training of dynamic balance and turning manoeuvres. The apparatus of the invention is represented by a parallel mechanism comprising: a base platform 1, on which universal joints 2,2' are arranged, said joints being connected with a pelvis element 5 by two vertical rods 3,3' via conventional spherical joints 4,4'.

Each universal joint 2,2 has two degrees of freedom, wherein one degree of freedom of the universal joint 2 is provided with a drive 6, whereas both degrees of freedom of the universal joint 2' are provided with drives 7,8.

The drives 6,7,8 are active servo drives, but can also be replaced by passive viscoelastic elements with variable impedance features.

The base platform 1 can be a simple panel, a motorised mobile platform or a motorised platform with a treadmill arranged, wherein the motorised platform can rotate around the vertical axis as will be described hereinbelow.

The apparatus for training dynamic balance and turning manoeuvres during walking according to the first embodiment of the invention has a total of four degrees of freedom with respect to the described components. Three degrees of freedom are motorised (provided with a drive) and one is passive as shown in FIGS. 2 to 9.

FIGS. 2 and 3 show inclination of the standing subject forward and backwards in a sagittal plane. Inclination forward and backwards can be assisted or guided (in terms of either positional servo guiding or impedance guiding) by the motor drives 6 and 7. FIGS. 4 and 5 show inclination of a standing subject to the left and right in a frontal plane. Inclination to the left and right is assisted or guided (in terms of either positional servo guiding or impedance guiding) by the drive 8.

FIGS. 6 and 7 show a key degree of freedom of the proposed apparatus of the invention, namely rotation of the pelvis of a standing subject around a vertical axis in the transversal plane in clockwise direction as well as in counterclockwise direction. The described rotation of the standing subject's pelvis can be assisted or guided (in terms of either positional servo guiding or impedance guiding) by adequate operation of the drives 6 and 7. Motion in all three described degrees of freedom (inclination forward/backwards, inclination left/right and rotation in transversal plane) can be simultaneous and can be adequately assisted by adequate operation of the drives 6, 7 and 8.

FIGS. 8 and 9 show a fourth degree of freedom of the proposed apparatus, i. e. passive tilt of the standing subject's pelvis forward and backwards in the sagittal plane. This degree of freedom is controlled by the standing subject.

All FIGS. 1 to 9 illustrate the use and functioning of the apparatus of the invention for the purposes of training of dynamic balance and rotation of the body around the vertical axis during standing.

Possible concrete variants of the universal joint 2,2' which in principle do not change the number of degrees of freedom and the described functionality of the entire apparatus of the invention and do not limit the present invention in any way whatsoever are shown in FIG. 10. Practical implementation of such a joint may be complicated as it requires precise manufacturing and fixation of both axes.

In a first constructional variant each universal joint 2,2' can be replaced by a vertical spring 20, one end of which is fastened to the base platform 1 and the other end is fastened to a vertical rod 3,3',30,30'. In this case, the entire mechanism is passive and exhibits mechanical impedance which is exerted on an individual's pelvis in the form of viscoelastic forces.

According to a second constructional variant each universal joint 2,2' can be replaced by two simple rotational joints 20',20" each having only one axis of rotation, and the first simple joint 20' is fixed to the base platform 1, whereas the second simple joint 20" is fixed to the axis of the first simple joint 20' in a way that the axes of rotation of both simple joints 20', 20" are perpendicular, yet do not intersect at the same point.

In the apparatus of the invention and the second embodiment the vertical rods 3,3' which have a defined, unadjustable length can be replaced by vertically adjustable rods 30,30' which can contain a translational joint that allows length adjustment of the rods 30,30' and each of them can be embodied as a telescopic assembly of two rods and also balanced, for instance with a spring or a similar constructional element that compensates for the weight of the pelvis element 5. A further adjustment option is also possible by a constructional variant where the upper end of the rods 3,3',30,30' is slidably through-connected with the spherical joints 4,4', which is shown in FIG. 11.

By the replacement of the vertical rods 3,3' with the vertically adjustable telescopic rods 30,30' the apparatus of the invention in the second embodiment thus provides for two new degrees of freedom: bias of the pelvis downwards/upwards in the frontal plane and a vertical shift of the pelvis downwards/upwards in all variants shown in FIGS. 1 to 9; a possibility of use of the vertically adjustable telescopic rods 30,30' is specifically shown in FIGS. 14 and 15.

In case when the base platform 1 is a motorised mobile platform, it allows training of dynamic balance and turning manoeuvres during walking on the ground. A sequence of images in FIG. 12 first shows walking in one direction, then follows a curve needed for an adequate change of direction during walking, which can be achieved in two ways. In the first way, the walking subject initiates a manoeuvre of turning to a new direction by adequately rotating the pelvis, which is followed by an adequate rotation of the mobile platform and the adequate movement of the apparatus. In the second way, the apparatus initiates rotation of the pelvis, which is followed by an adequate rotation of the mobile platform. In both ways the walking subject has a possibility of training of dynamic balance and turning manoeuvres assisted by motorised degrees of freedom that suit his/her current abilities.

In case when the base platform 1 is a motorised platform with a treadmill that can rotate around the vertical axis, it allows training of dynamic balance and turning manoeuvres during walking on the treadmill. A sequence of images in FIG. 13 shows a turning manoeuvre that is principally identical to the turning manoeuvre shown in FIG. 12, a difference being in that here the mobile platform cannot freely move in a space but is limited to the rotation about the fixed axis of rotation.

In case when the base platform 1 is a motorised mobile platform according to the second embodiment shown in FIG. 14, it allows in addition to the already disclosed possibilities of manoeuvring with the apparatus of the invention according to the first embodiment, as described and shown in FIG. 13, also rotating of the pelvis upwards/downwards in the frontal plane and the vertical shift of the pelvis upwards/downwards.

In case when the base platform 1 is a motorised platform with a treadmill according to the second embodiment of FIG. 15 that can rotate around the vertical axis, it allows training of dynamic balance and turning manoeuvres during walking on the treadmill. A sequence of images in FIG. 15 shows a turning manoeuvre that is principally identical to the turning manoeuvre shown in FIG. 14, a difference being in that the mobile platform in this case is not limited only to rotation around the fixed axis of rotation but the axis of rotation can be anywhere, also for instance in the centre of the conveyor belt.

The inventive aspect of the proposed apparatus for training of dynamic balance and turning manoeuvres during walking of the invention resides especially in a unique kinematic structure that enables the subject to train dynamic balance and rotation around the vertical body axis by a simultaneous motion of the lower body segments in the sagittal and frontal planes while standing, walking on the ground and walking on the treadmill that can rotate around the vertical axis. The motion of the proposed apparatus of the invention is from the biomechanical and physiological aspects in consistence with the motion of a human locomotor apparatus.

The invention claimed is:

1. An apparatus for training dynamic balance and turning maneuvers during walking, the apparatus comprising:

a base platform on which two first-type joints are arranged, each of the two first-type joints having a first side connection and a second side connection, and having two degrees of freedom between the first side connection and the second side connection, each of the two first-type joints are coupled to the base platform by the first side connection, a pelvis element, wherein the pelvis element is connected to two spherical joints, the two spherical joints each having three degrees of freedom, the two spherical joints are respectively connected with two vertical rods or vertically adjustable rods, wherein the two vertical rods or vertically adjustable rods are respectively connected to the second side connection of the two first-type joints, wherein the two vertical rods or vertically adjustable rods are each spaced apart from the respective two spherical joints, and wherein the pelvis element is configured to be operably positionable through six degrees of freedom, to, in turn, allow for following and supporting of a pelvis of a user of a user positioned therein through six degrees of freedom.

2. The apparatus according to claim 1 wherein a first of the two first-type joints has a first degree of freedom coupled to a first drive, and a second of the two first-type joints has a first degree of freedom coupled to a second drive, and a second degree of freedom coupled to a third drive.

3. The apparatus according to claim 2 wherein each of the two first-type joints comprises one of a vertical spring with a first end defining the first side connection and a second end defining the second side connection, or two simple rotational joints coupled to each other, wherein each of the two simple rotational joints has a single axis of rotation, and wherein a first of the two simple rotational joints is fastened to the base platform and a second of the two simple rotational joints is fastened to the single axis of rotation of the first simple rotational joint (20') so that that the single axis of rotation of the first simple joint and the single axis of rotation of the second simple rotational joint are perpendicular, and also do not intersect at a same point.

4. The apparatus according to claim 2 wherein the first, second and third drives comprise one of: active servo drives; and passive viscoelastic elements with variable impedance features.

5. The apparatus according to claim 1 wherein the base platform comprises one of: a simple panel; a motorized mobile platform; and a motorized platform with a treadmill arranged wherein the motorized platform with the treadmill can rotate around a vertical axis of the treadmill.

* * * * *